US010408460B2

(12) United States Patent
Lee et al.

(10) Patent No.: US 10,408,460 B2
(45) Date of Patent: Sep. 10, 2019

(54) GAS COOKER AND VALVE ASSEMBLY FOR GAS COOKER

(71) Applicant: LG ELECTRONICS INC., Seoul (KR)

(72) Inventors: Dongjae Lee, Seoul (KR); Junho Seok, Seoul (KR); Jongryul Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 232 days.

(21) Appl. No.: 15/254,476

(22) Filed: Sep. 1, 2016

(65) Prior Publication Data

US 2017/0067646 A1 Mar. 9, 2017

(30) Foreign Application Priority Data

Sep. 3, 2015 (KR) ..... 10-2015-0125174

(51) Int. Cl.
*F24C 3/12* (2006.01)
*F23N 1/00* (2006.01)
(Continued)

(52) U.S. Cl.
CPC ..... *F24C 3/124* (2013.01); *F23N 1/002* (2013.01); *F24C 3/067* (2013.01); *F24C 3/085* (2013.01);
(Continued)

(58) Field of Classification Search
CPC ..... F24C 3/124; F24C 3/022; F24C 3/067; F24C 3/085; F24C 3/126; F24C 15/006;
(Continued)

(56) References Cited

U.S. PATENT DOCUMENTS 5,509,403 A 4/1996 Kahlke et al.
5,875,773 A * 3/1999 Jansen ..... F24C 3/126 126/39 E
(Continued)

FOREIGN PATENT DOCUMENTS

CN 200972161 11/2007
CN 201448884 5/2010
(Continued)

OTHER PUBLICATIONS

Korean Office Action dated Sep. 13, 2016 issued in Application No. 10-2015-0125174.
(Continued)

*Primary Examiner* — Gregory L Huson
*Assistant Examiner* — Daniel E Namay
(74) *Attorney, Agent, or Firm* — Ked & Associates LLP

(57) ABSTRACT

A gas cooker may include a case, a top plate that shields an upper surface of the case and on which items to be cooked are seated, a plurality of burners provided inside of the case, an electric valve assembly that controls a gas supply to the plurality of burners, a main pipe connected to the electric valve assembly and that supplies gas, and a plurality of branched pipes, respectively, connected to the electric valve assembly and the plurality of burners. The electric valve assembly may include a main valve connected to the main pipe, a plurality of sub-valves respectively connected to the plurality of branched pipes, and a manifold that connects the main valve and the plurality of sub-valves in parallel and enables the main valve and the plurality of sub-valves to be consecutively provided and configured in a single assembly form.

20 Claims, 15 Drawing Sheets

(51) Int. Cl.
*F24C 15/00* (2006.01)
*F24C 3/08* (2006.01)
*F24C 3/06* (2006.01)

(52) U.S. Cl.
CPC ..... *F24C 3/126* (2013.01); *F24C 15/006* (2013.01); *F23K 2900/05002* (2013.01); *F23N 2035/18* (2013.01); *F23N 2037/02* (2013.01)

(58) Field of Classification Search
CPC .. F23N 1/002; F23N 2035/18; F23N 2037/02; F23K 2900/05002
USPC ..... 126/39 BA
See application file for complete search history.

(56) References Cited

U.S. PATENT DOCUMENTS

| | | | | |
|---|---|---|---|---|
| 6,036,107 | A * | 3/2000 | Aspen | A01M 7/0089 137/883 |
| 6,076,517 | A | 6/2000 | Kahlke et al. | |
| 6,363,971 | B1 | 4/2002 | Kaylan et al. | |
| 2004/0229177 | A1 | 11/2004 | Telthoerster et al. | |
| 2006/0213496 | A1 | 9/2006 | Kimble et al. | |
| 2006/0231085 | A1* | 10/2006 | Gnadinger | F24C 3/126 126/39 N |
| 2008/0153047 | A1* | 6/2008 | Lee | F23D 14/48 431/354 |
| 2010/0132691 | A1* | 6/2010 | Leidig | F24C 3/067 126/39 BA |
| 2016/0069571 | A1* | 3/2016 | Lewis, Jr. | F24C 3/124 99/337 |

FOREIGN PATENT DOCUMENTS

| | | |
|---|---|---|
| EP | 1 876 393 | 1/2008 |
| JP | H10-103621 | 4/1998 |
| JP | 2005-061692 | 3/2005 |
| JP | 2008-089229 | 4/2008 |
| JP | 3140622 U | 4/2008 |
| JP | 2009-041871 | 2/2009 |
| JP | 2011-099643 | 5/2011 |
| KR | 10-2008-0069449 | 7/2008 |
| WO | WO 2008/091057 | 7/2008 |
| WO | WO 2009/011130 | 1/2009 |

OTHER PUBLICATIONS

European Search Report dated Feb. 15, 2017.
Korean Office Action dated Feb. 17, 2017.
Japanese Office Action dated Jul. 27, 2017.
Chinese Office Action dated Apr. 4, 2018.
Japanese Office Action dated Jun. 19, 2018.

* cited by examiner

GAS COOKER AND VALVE ASSEMBLY FOR GAS COOKER

CROSS-REFERENCE TO RELATED APPLICATION(S)

The application claims priority under 35 U.S.C. § 119 and 35 U.S.C. § 365 to Korean Patent Application No. 10-2015-0125174, filed in Korea on Sep. 3, 2015, whose entire disclosure is hereby incorporated by reference.

BACKGROUND

1. Field

A gas cooker and a valve assembly for the gas cooker are disclosed herein.

2. Background

Generally, a gas cooker is a home appliance that cooks or heats food or other items using a flame generated by burning a gas. The gas cooker has a burner that generates the flame by burning a gas. The gas cooker is classified into an open-flame type, in which a burner is exposed to an outside of a product, and the flame directly heats food or heats a container containing the food, and a radiant type, in which the burner is provided inside of the product, a radiator is heated using combustion heat, and the food or the container in which the food is located is heated using a radiant wave emitted from the heated radiator to an outside.

Korean Patent Publication No. 10-2008-0069449, which is hereby incorporated by reference, discloses a heating cooker in which an upper surface of a case is shielded by a ceramic plate, a burner system ignited by supplying a gas is provided at an internal space of the case under the ceramic plate, and heating power is controlled by opening and closing a gas valve through operation of an operation switch. However, in the heating cooker having such a structure, the gas valves are disposed in front and spaced apart from each other, such that they relatively take up a lot of space. Also, an overall size of the heating cooker is increased by using a mechanical gas valve, which may be directly opened and closed by the operation of the operation switch, and thus, there is a problem that a loss of the space is huge during a built-in mounting.

Further, a separate configuration to prevent a safety accident when an abnormality of the gas valve occurs is not present, and thus, there is a problem that stability is low. Furthermore, as each of the gas valves has a separate mounting structure, there is a problem that an assembly workability is degraded and productivity decreased.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. The embodiments may, however, be embodied in many different forms and should not be construed as being limited to the embodiments set forth herein; rather, alternative embodiments falling within the spirit and scope can easily be derived through adding, altering, and removing, and will fully convey the concept to those skilled in the art.

Figure 1:
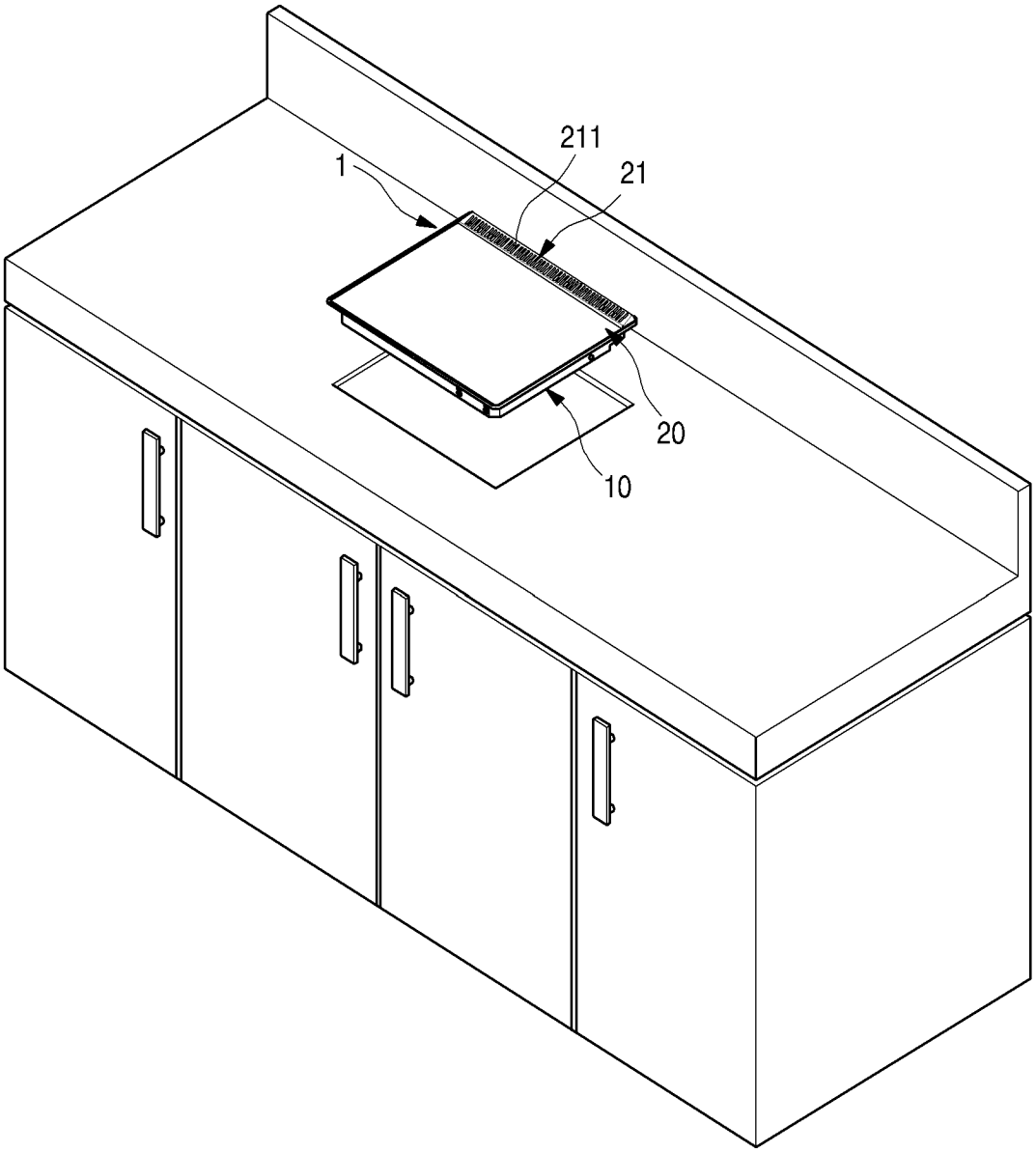
FIG. 1 is an exploded perspective view illustrating a state in which a gas cooker according to an embodiment is installed.

FIG. 1 is an exploded perspective view illustrating a state in which a gas cooker according to an embodiment is installed. As illustrated in the drawing, a gas cooker 1 according to an embodiment may be installed at an upper surface of furniture, such as a countertop and cabinet. The gas cooker 1 may be seated in an opening formed at an upper surface of the countertop, and an exterior thereof exposed through the upper surface of the countertop may be formed by a top plate 20. An entire exterior of the gas cooker 1 may be configured with a case 10, the top plate 20, and a grille vent 21.

The case 10 may be formed of a plate-shaped steel material, for example, and an upper surface thereof may be bent to be opened, and thus a space in which a plurality of elements that operates the gas cooker 1 may be accommodated, may be provided therein. When the gas cooker 1 is installed at the countertop, the case 10 may be in an accommodated state inside the opening in the countertop.

The top plate 20 forming an upper surface of the gas cooker 1 may be provided at the open upper surface of the case 10. The top plate 20 may shield the opening of the countertop while the gas cooker 1 is installed in the countertop, may be exposed through the upper surface, and form an exterior of the upper surface of the gas cooker 1. The top plate 20 may provide a flat surface on which food or other items to be cooked or heated may be seated.

The grille vent 21, through which exhaust gas may be discharged, may be provided at a rear end of the top plate 20. The grille vent 21 may be formed to slightly protrude from the top plate 20, and a plurality of vent holes 211 may be opened at the grille vent 21 so that the exhaust gas may be discharged through the vent holes 211.

Figure 2:
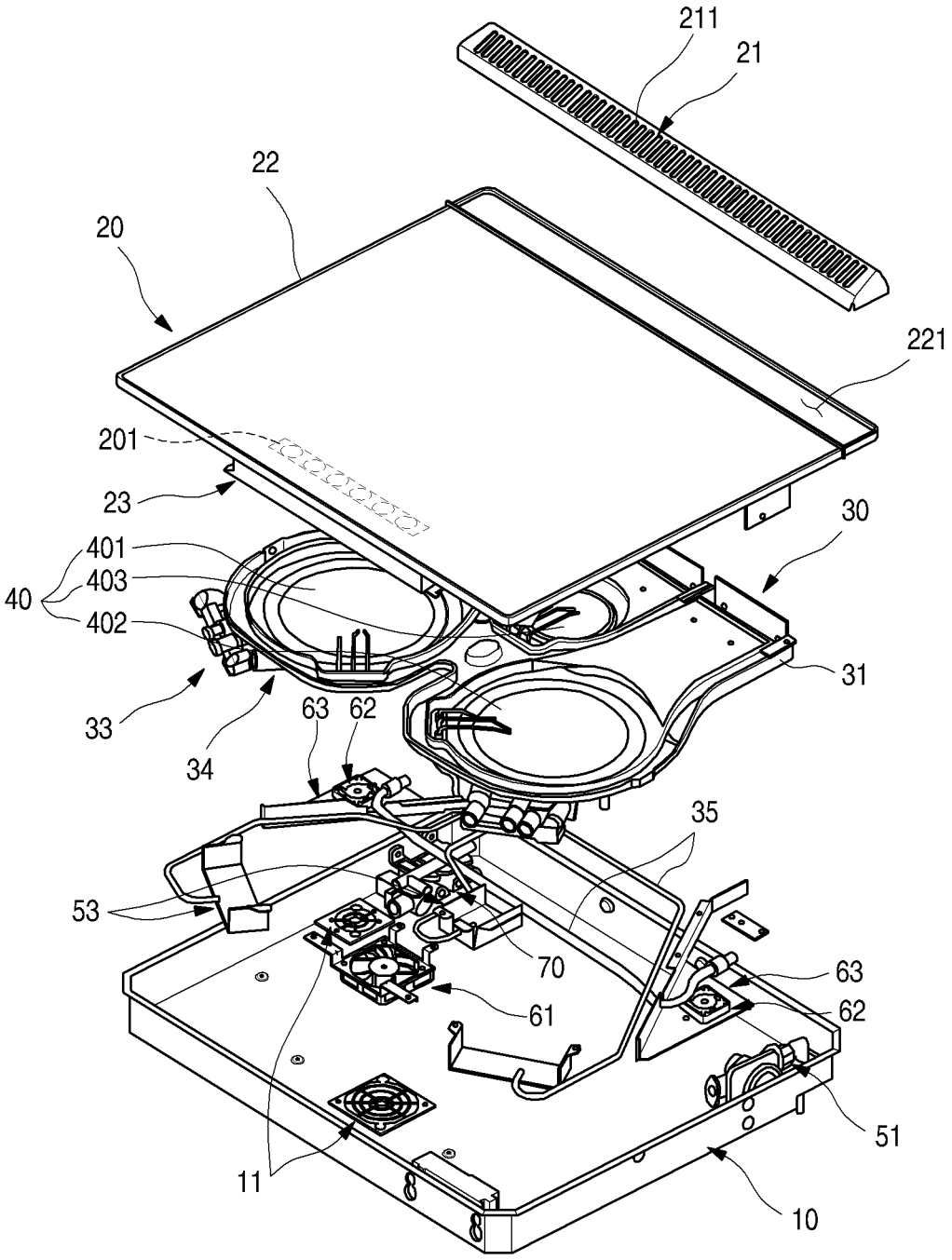
FIG. 2 is an exploded perspective view of the gas cooker of FIG. 1.
Figure 3:
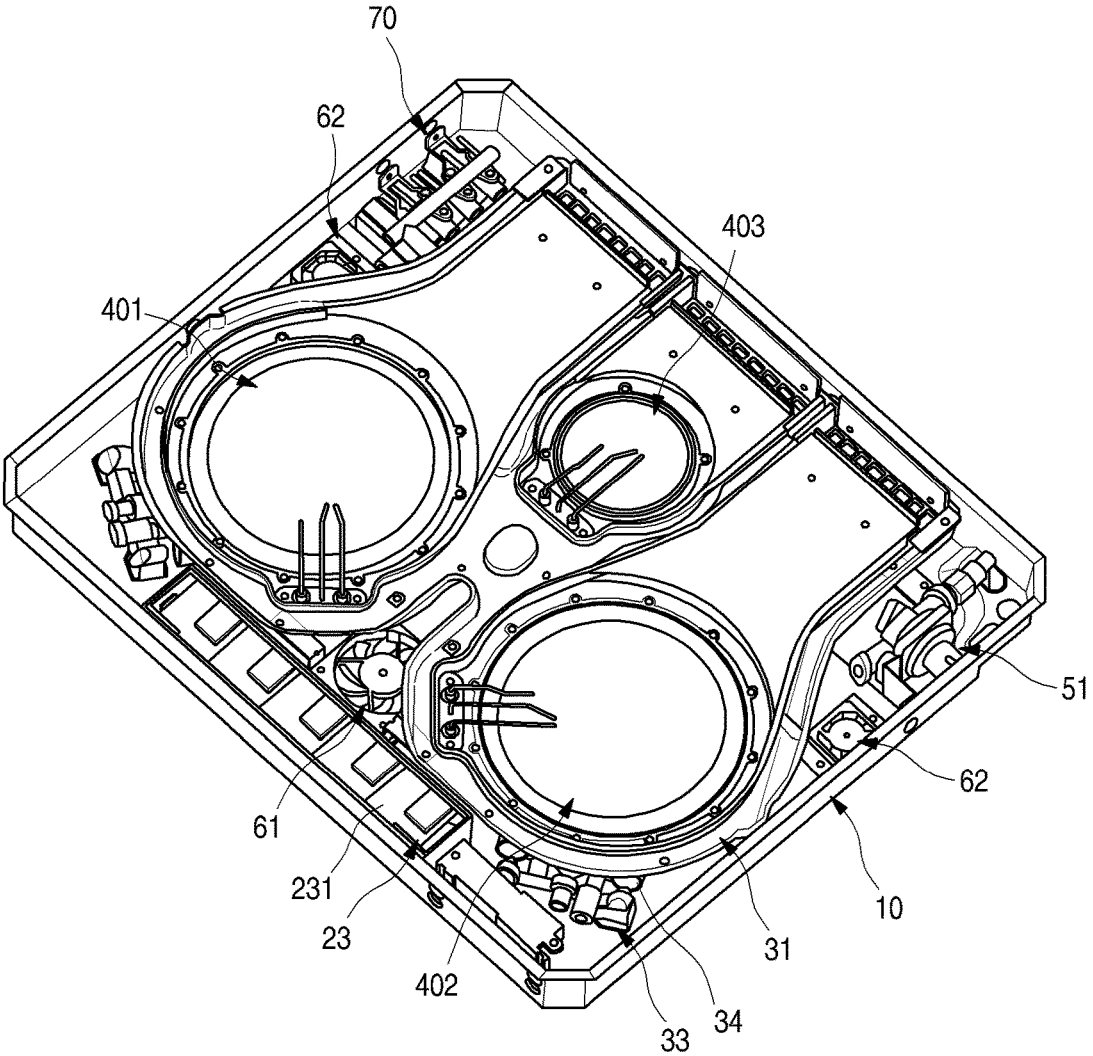
FIG. 3 is a perspective view illustrating a state in which a top plate of the gas cooker of FIG. 1 is removed.

FIG. 2 is an exploded perspective view of the gas cooker of FIG. 1. FIG. 3 is a perspective view illustrating a state in which a top plate of the gas cooker of FIG. 1 is removed.

Figure 4:
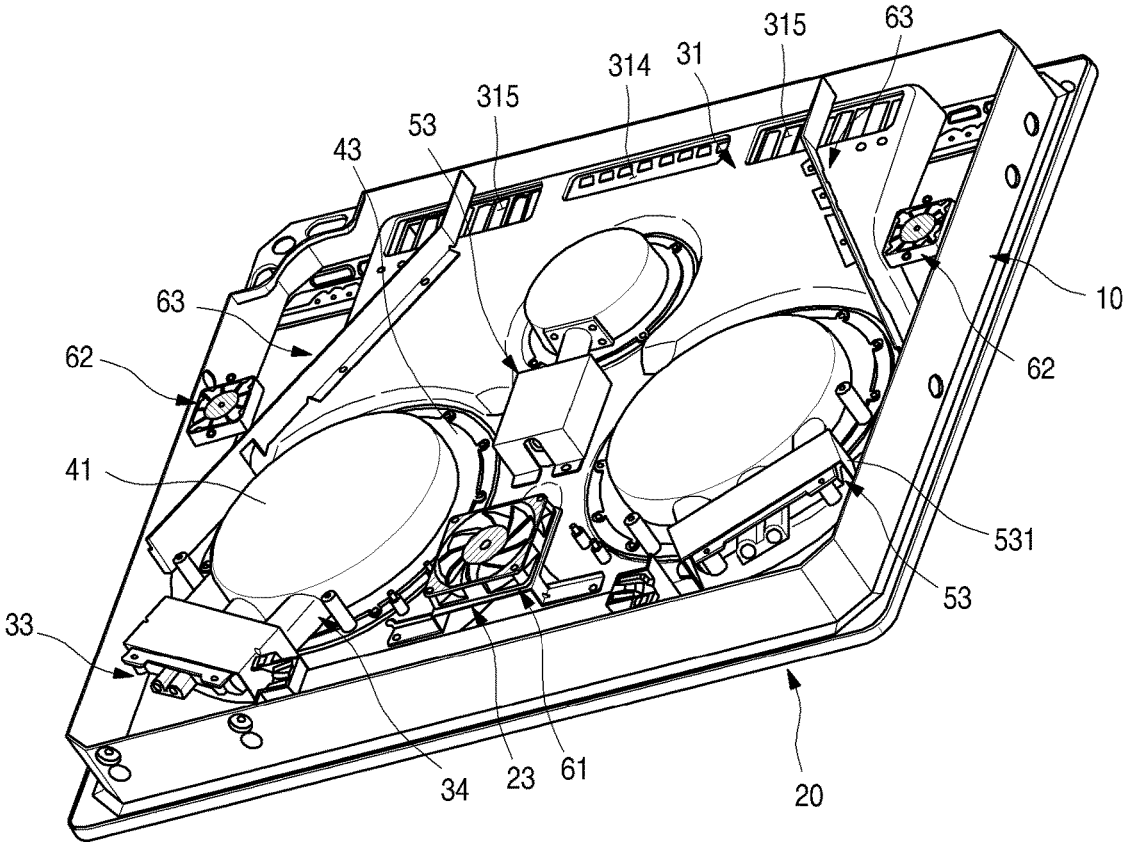
FIG. 4 is a partially cut-away view illustrating a state in which a lower surface of a case of the gas cooker of FIG. 1 is cut away.

FIG. 4 is a partially cut-away view illustrating a state in which a lower surface of a case of the gas cooker of FIG. 1 is cut away.

A configuration of the gas cooker will be described with reference to the drawings. The upper surface of the gas cooker 1 may be formed by the top plate 20, and the rest of the exterior except for the upper surface may be formed by the case 10.

The top plate 20 may be formed of a ceramic glass material. A top frame 22 may be provided at a perimeter of the top plate 20, and may form an exterior of a perimeter of the top plate 20. A grille vent seating portion or seat 221, which may be opened so that the grille vent 21 may be seated therein may be further formed at the top frame 22.

An operation unit or panel 23 may be provided under the top plate 20. The operation panel 23 may be operated by a user to control a heating power of the gas cooker 1, and may be operated by a user's touch operation. Of course, the operation panel 23 may be configured with an electronic switch or a sensor, instead of a touch method.

An operation part 201, which enables the user to recognize an operating portion of the operation panel 23, may be formed at an upper surface of the top plate 20 corresponding to the operation panel 23. The operation part 201 may be formed at the upper surface of the top plate 20 using a printing method or a film attaching method, and may also be formed as a transparent or translucent type so that at least a portion of the operation panel 23 may be exposed or viewable. Also, the operation part 201 may be formed not to be recognized or viewable from an outside through the top plate 20 before an operation thereof, but to be recognized or viewable from the outside by turning on a separate backlight.

The operation panel 23 may be located at a front end of the top plate 20, and may be formed so that an upper end of the operation panel 23 is in completely close contact with the top plate 20. The operation panel 23 may also be formed to be coupled to the top plate 20, and thus, to be disassembled from or assembled to the case 10 in a module form.

The open upper surface of the case 10 may be formed to have a somewhat smaller area than an area of the top plate 20, and may also be formed to have a structure in which a perimeter of the top plate 20 further protrudes to an outside of the case 10 when coupled to the top plate 20. An exterior of the case 10 may be formed by bending the steel plate material, and if necessary, may be formed by injection-molding a resin material.

When the top plate 20 and the case 10 are coupled to each other, a space may be formed inside of the case 10, and a burner unit or assembly 30 may be provided in the space. The burner assembly 30 may include a plurality of burners 40, in which combustion of a supplied mixed gas may occur, and an insulator case 31, at or in which the plurality of burners 40 may be fixed and installed.

Each of the plurality of burners 40 may have a nozzle 33 that supplies the gas, and a mixing tube 34, through which a fuel gas and air may be mixed and introduced to a burner pot 41 may be provided at an outlet side of the nozzle 33. The nozzle 33 and the mixing tube 34 may be formed in one module, and may be respectively fixed to and installed at the burner pot 41.

The plurality of burners 40 may be provided, and may include a first burner 401 and a second burner 402, which may be provided at both of first and second (left and right in the drawings) sides inside of the case 10, and a third burner 403, which may be provided between the first burner 401 and the second burner 402 and having a size smaller than each of the first burner 401 and the second burner 402. All of the first burner 401, the second burner 402, and the third burner 403 may be seated on the insulator case 31, and may be installed inside of the case 10. A number of burners 40 and a size of each of the burners 40, which are installed at the insulator case 31, are not limited to the proposed embodiment, and may be variously applied.

A gas pipe 35 may be provided inside of the case 10. The gas pipe 35 may connect a regulator 51 and a valve unit or assembly 70 with the plurality of burners 40 so that the gas may be supplied to each of the plurality of burners 40. A main fan 61 and sub-fans 62 may be provided inside of the case 10.

Figure 5:
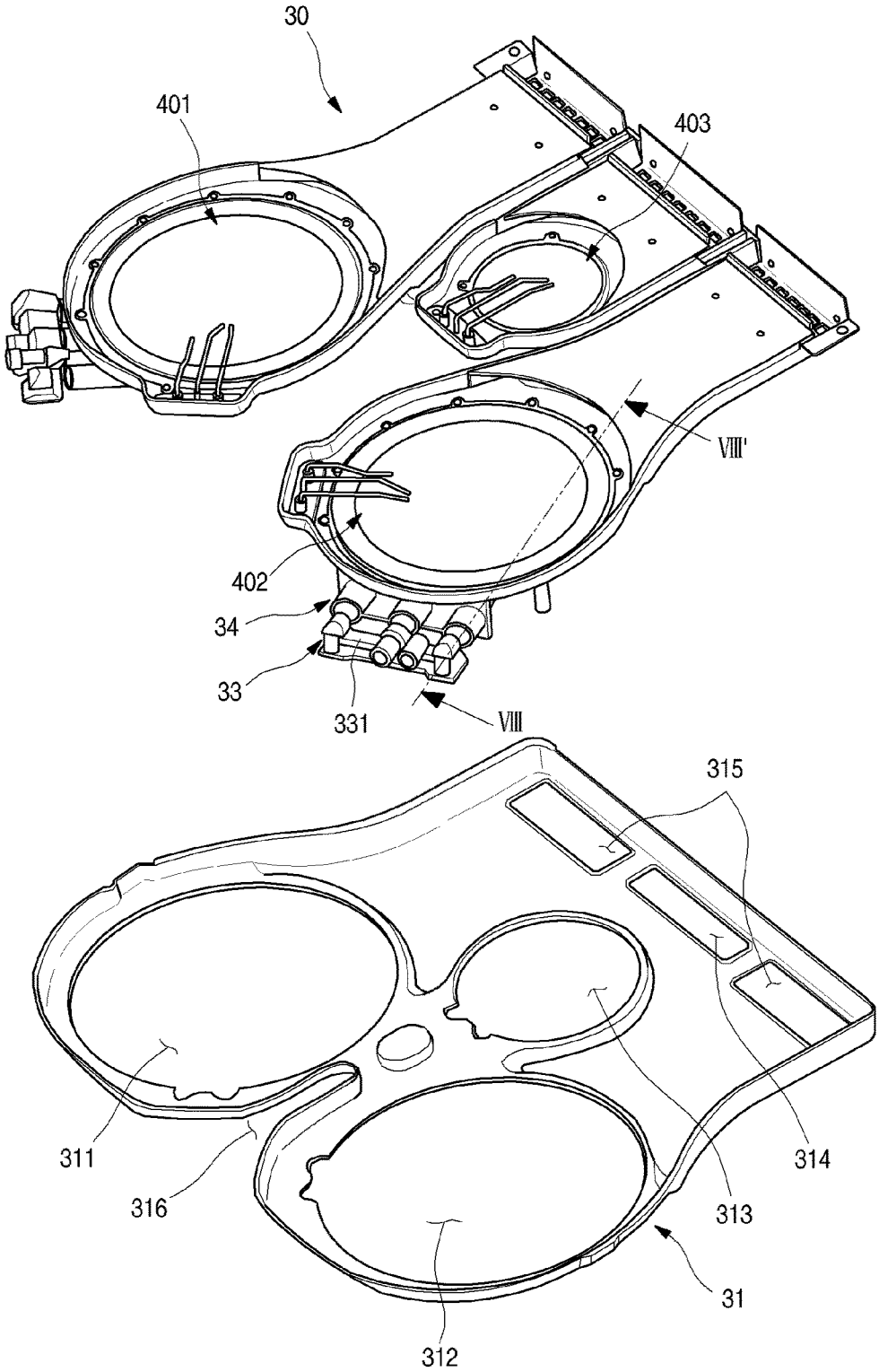
FIG. 5 is an exploded perspective view of a burner assembly of the gas cooker of FIG. 1.
Figure 6:
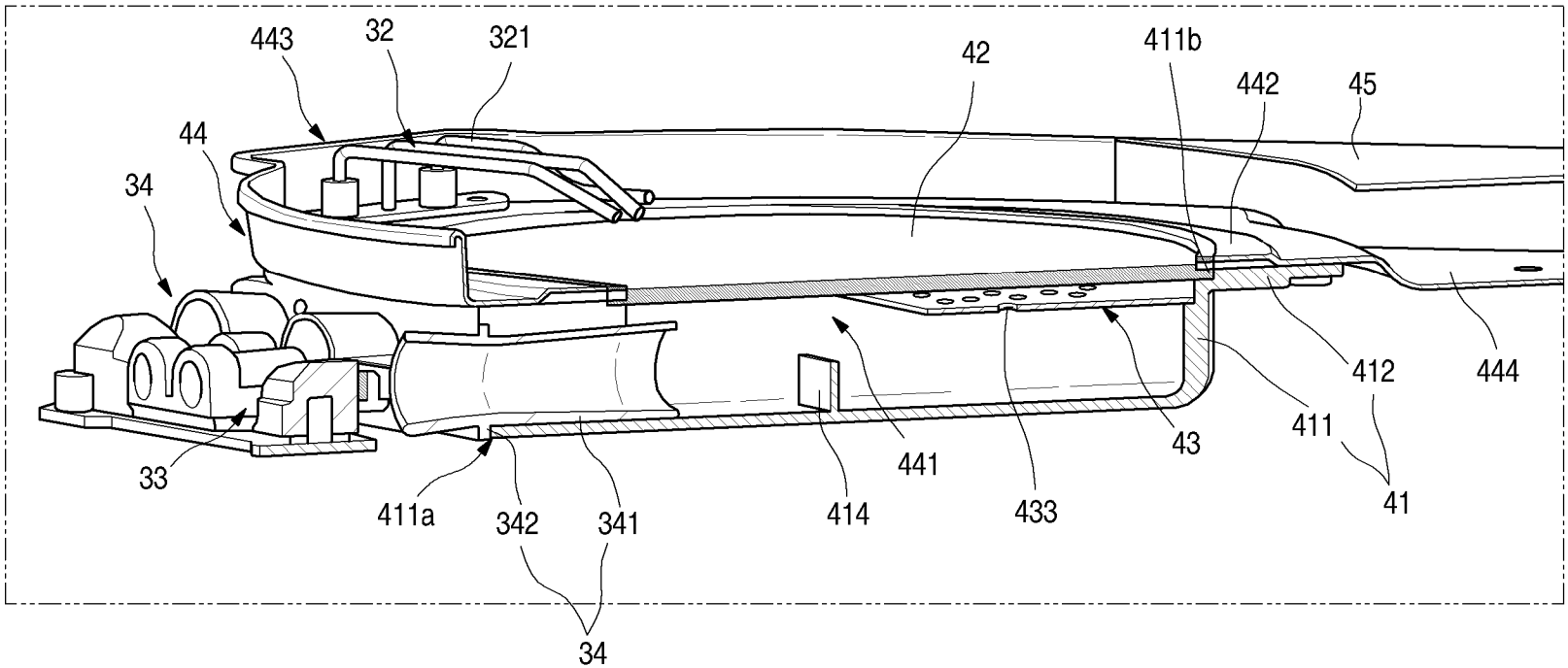
FIG. 6 is a partially cut-away perspective view of a burner according to an embodiment.

FIG. 5 is an exploded perspective view of a burner assembly of the gas cooker of FIG. 1. FIG. 6 is a partially cut-away perspective view of a burner according to an embodiment.

The burner assembly 30 may include the plurality of burners 40, and the insulator case 31 at which the plurality of burners 40 may be seated. The plurality of burners 40 may include the first burner 401 and the second burner 402, which may be provided at both of the first and second sides, and the third burner 403, which may be provided between the first burner 401 and the second burner 402. The third burner 403 may be located at a rear side slightly further back than the second burner 402, and may have the size smaller than the first burner 401 and the second burner 402.

The insulator case 31 may have a shape an upper surface of which is open to accommodate the plurality of burners 40, and the insulator case 31 may have a structure in which an upper end thereof is in contact with the top plate 20 or the upper surface thereof is shielded by the top plate 20. A first burner hole 311, a second burner hole 312, and a third burner hole 313, at which the first burner 401, the second burner 402, and the third burner 403 may be respectively located, may be formed at the insulator case 31 so as to be open.

An exhaust port, through which exhaust gas generated by the combustion and internal air of the case 10 may be discharged, may be formed at a rear end of the insulator case 31. The exhaust port may include a central exhaust port 314 formed at a center, and side exhaust ports 315 formed at both sides of the central exhaust port 314.

An area of the central exhaust port 314 may be formed to be slightly narrower than an area of each of the side exhaust ports 315. This is to reduce an amount of high-temperature exhaust gas discharged through the central exhaust port 314, and thus, to reduce a temperature of an entire exhaust gas because a distance between the central exhaust port 314 and the third burner 403 is relatively shorter than a distance between the first and second burners 401 and 402 and the side exhaust ports 315. That is, an amount of exhaust gas discharged through the side exhaust ports 315 having a relatively low temperature may be greater than an amount of exhaust gas discharged through the central exhaust port 314, and thus, the temperature of the entire exhaust gas which may be mixed and discharged may be reduced.

An opening 316, through which cooling air blown from the main fan 61 may pass, may be formed at a front end of the insulator case 31. A lower surface of the top plate 20 may be cooled by the opening 316, and more particularly, the operation part 201, which may be touched and operated by a user, may be intensively cooled.

The number and arrangement of the plurality of burners 40 installed or provided at or in the insulator case 31 may be variously changed, and a structure of the insulator case 31 may be determined according to the number and the arrangement of the burners 40.

Hereinafter, a structure of each of the plurality of burners 40 will be described. The plurality of burners 40 according to an embodiment may include the first burner 401, the second burner 402, and the third burner 403. However, each of the burners 40 may be different only in arrangement and a size thereof, and may have a same basic structure. Therefore, hereinafter, a structure of each of the plurality of burners 40 will be described based on the second burner 402. As the first burner 401 and the third burner 403 may have the same structure, a detailed description thereof has been omitted.

As illustrated in the drawings, each burner 40 may include the burner pot 41, to which mixed gas may be supplied, a red-hot plate 42, which may be seated at the burner pot 41 to be heated by the combustion of the mixed gas, and a burner holder 44 and a burner cover 45 which may support the burner pot 41 and the red-hot plate 42. The burner pot 41 may be formed in a circular shape which is open in an upward direction. The burner pot 41 may include an accommodating portion 411, in which the mixed gas may be accommodated, and a flange 412, which may be bent in an outward direction from an end of the accommodating portion 411. The mixing tube 34 may be inserted and installed or provided into one side of an outer portion of the accommodating portion 411, and while the mixing tube 34 is installed, an inlet port of the mixing tube 34 may protrude to an outside of the accommodating portion 411, and an outlet port of the mixing tube 34 may extend to a predetermined location inside of the accommodating portion 411.

The mixing tube 34 may include a plurality of extension tubes 341, which may be disposed or provided to be spaced apart from each other, and a tube holder 342 that connects the plurality of extension tubes 341 and is fixed to and installed or provided at a tube insertion hole 411 a. Each of the plurality of extension tubes 341 may extend from an outside of the burner pot 41 toward an inside thereof, and outlet ports of the plurality of extension tubes 341 may be located or provided in or at a same depth inside of the burner pot 41.

The plurality of extension tubes 341 may be disposed or provided at regular intervals, so that the gas supplied through the nozzle 33 may be evenly introduced into the burner pot 41. In this embodiment, three extension tubes 341 are provided; however, two or more extension tubes 341 may be variously provided.

A plurality of nozzles 33, through which the mixed gas may be injected may be fixed by a nozzle holder 331, and an outlet port of each of the nozzles 33 may be located or provided at a location corresponding to an inlet port of each of the plurality of extension tubes 341. That is, the inlet port of the mixing tube 34 may be located or provided at the location corresponding to the outlet port of the nozzle 33 to be spaced apart by a predetermined gap, such that air may be mixed together by a pressure difference due to a flow of the gas when the gas is injected through the nozzle 33.

An ignition rib 414 may be formed at one side thereof, which may be spaced apart from the outlet port of the mixing tube 34, to protrude in an upward direction. The ignition rib 414 may extend in a direction crossing a discharging direction of the mixed gas discharged from the outlet port of the mixing tube 34. The ignition rib 414 may be located close to an end of a spark plug 32. Therefore, the mixed gas discharged through the outlet port of the mixing tube 34 may flow in an upward direction due to the ignition rib 414, and may easily be ignited by the spark plug 32.

A distribution plate 43 may be mounted on an upper surface of the accommodating portion 411. The distribution plate 43 may be formed in a semi-circular plate shape to shield a portion of an open upper surface of the accommodating portion 411. Therefore, the mixed gas introduced through the mixing tube 34 may flow again at a lower side of the distribution plate 43 in an opposite direction. At this point, the distribution plate 43 may shield the supplied mixed gas from flowing through an upper side thereof. A plurality of distribution holes 433 may be formed at or in the distribution plate 43. Therefore, a portion of the mixed gas strongly discharged from the mixing tube 34 may come around in the direction opposite to the discharging direction by the distribution plate 43 and the ignition rib 414, and another portion thereof may be supplied in the upward direction through the distribution holes 433.

The red-hot plate 42 may be seated on the plate seating portion or seat 411 b formed at an upper end of the accommodating portion 411. The red-hot plate 42 may completely shield the open upper surface of the accommodating portion 411. The red-hot plate 42 may be formed of a porous ceramic mat, and the mixed gas flowing in the upward direction at the accommodating portion 411 may be burned at the red-hot plate 42. The red-hot plate 42 may be formed of another material which is usable at the radiant burner 40.

The burner pot 41 may be seated at or in the burner holder 44. A burner hole 441 may be opened at the burner holder 44, and the burner pot 41 may be inserted into the burner hole 441. A pot seating portion or seat 442 formed may be formed as a step at a circumference of the burner hole 441, and the flange 412 of the burner pot 41 may be seated at the pot seat 442. A fastening member passing through the flange 412 may be fastened to the pot seat 442, and thus, the burner pot 41 may be fixed to and installed at the burner holder 44.

A plug installing portion 443 may be formed at one side of the burner holder 44. The spark plug 32 may be fixed to and installed at the plug installing portion 443. The spark plug 32 may serve to ignite the mixed gas in the burner 40, may be provided above the red-hot plate 42, and may extend from an outside of the red-hot plate 42 toward an inside thereof to ignite the mixed gas. A flame detector 321 may be provided at one side of the spark plug 32. The flame detector 321 may serve to check an ignition state of the burner 40 through a change in a voltage or a temperature of the red-hot plate 42, may be formed in a module integrally formed with the spark plug 32, and may extend along with the spark plug 32 from an upper side of the red-hot plate 42 toward the inside of the red-hot plate 42.

A burned gas guide portion or guide 444 formed to extend in a backward direction may be formed at the burner holder 44. The burned gas guide 444 may extend to a rear end of the case 10 corresponding to a location of the grille vent 21. Therefore, the burned gas generated when the combustion occurs at the burner 40 may be guided to the grille vent 21 along the burner holder 44, and then may be discharged to an outside.

The burner cover 45 may be provided above the burned gas guide 444. The burner cover 45 may form a flow path of the burned gas along with the burned gas guide 444, and shield an open upper side of the burned gas guide 444. A rear end of the burner cover 45 may be spaced apart from a rear end of the burned gas guide 444, such that cooling air passed through the exhaust ports 314, 315 and the burned gas passing through the burned gas guide 444 may be mixed and then discharged.

Meanwhile, although not illustrated, an insulator that prevents heat of the burner assembly 30 from being transferred to the outside of the case 10 or some areas of the top plate 20 may be provided between the burner holder 44 and the top plate 20 and between the burner holder 44 and the insulator case 31.

Figure 7:
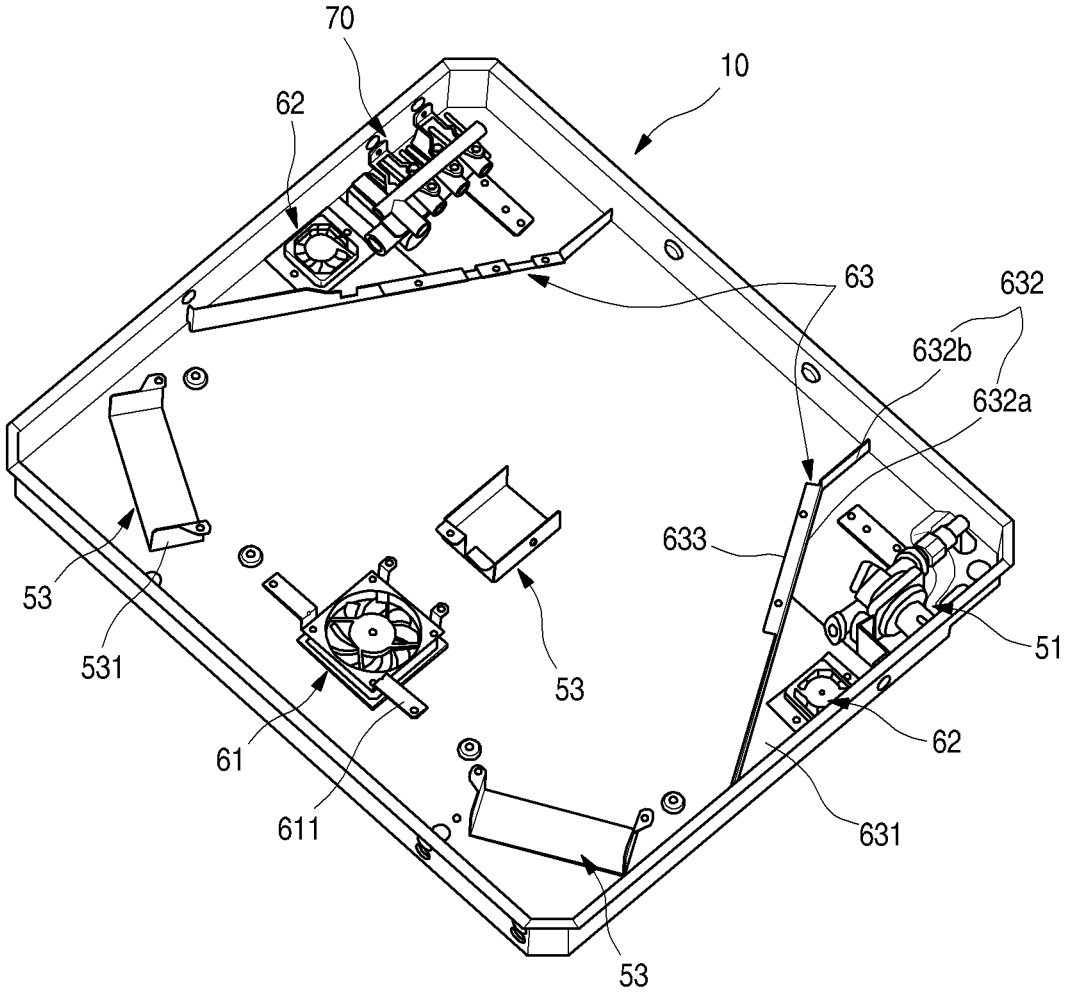
FIG. 7 is a perspective view illustrating a state in which a valve assembly and a regulator are installed inside of the case of the gas cooker of FIG. 1.
Figure 8:
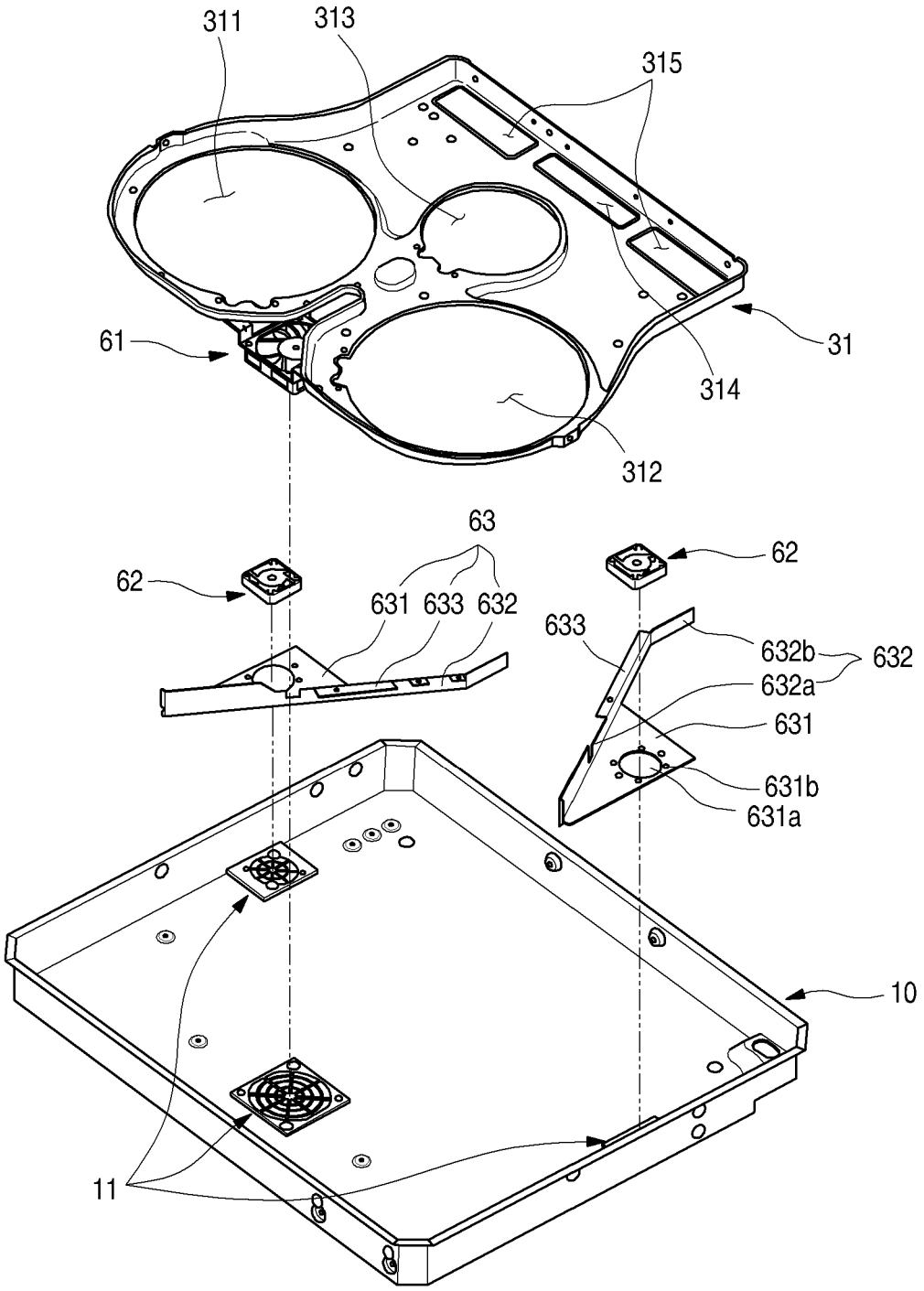
FIG. 8 is an exploded perspective view illustrating a coupling structure of the case, an insulator case, and a cooling fan of the gas cooker of FIG. 1.
Figure 9:
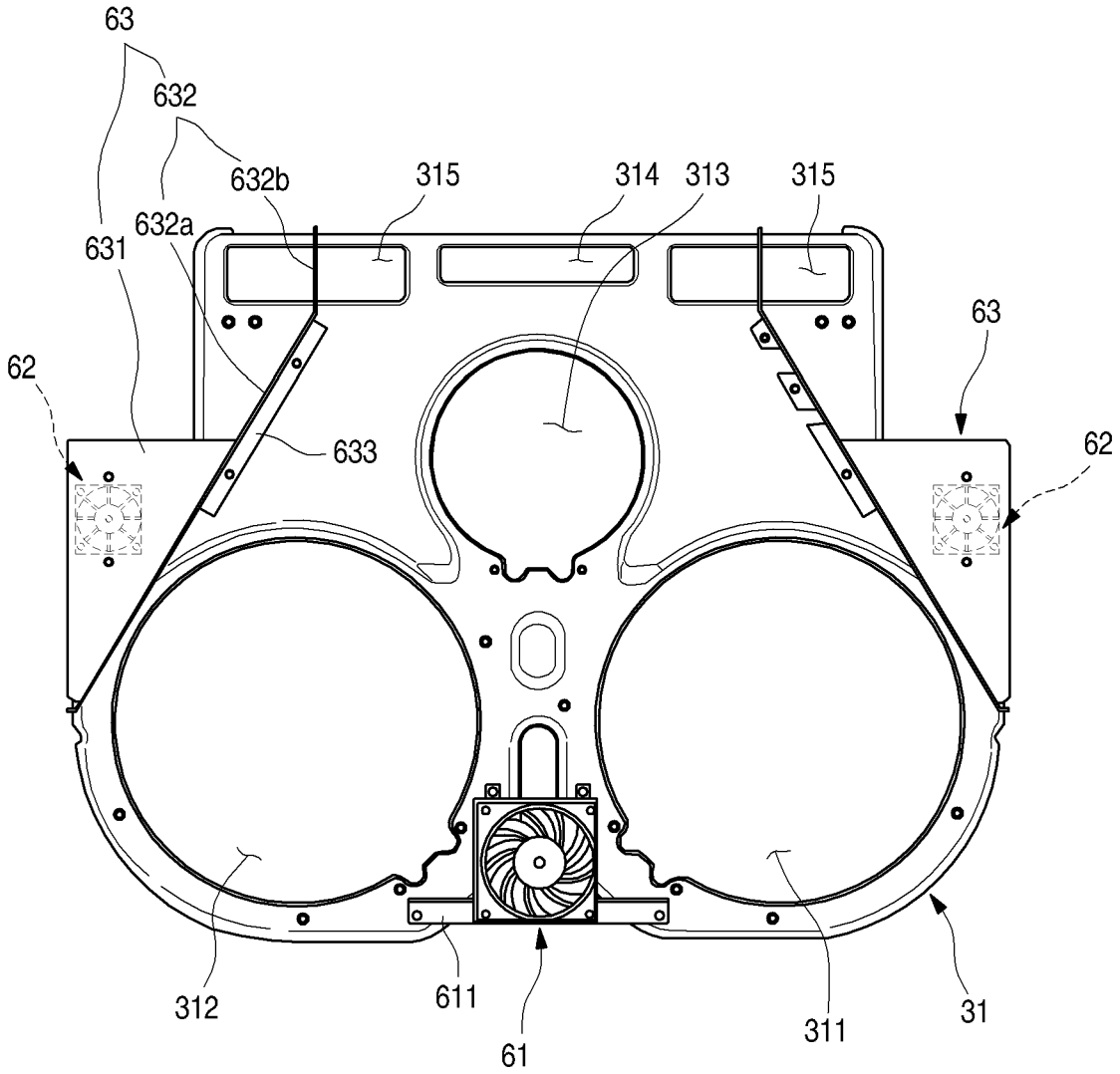
FIG. 9 is a bottom view of the insulator case.

FIG. 7 is a perspective view illustrating a state in which a valve unit or assembly and a regulator are installed inside of the case of the gas cooker of FIG. 1. FIG. 8 is an exploded perspective view illustrating a coupling structure of the case, an insulator case, and a cooling fan of the gas cooker of FIG. 1. FIG. 9 is a bottom view of the insulator case.

As illustrated in the drawings, the main fan 61 and the sub-fans 62 for airflow in the case 10 may be provided inside of the case 10. Each of the main fan 61 and the sub-fans 62 may be a box fan, and may also be formed to suction air outside of the case 10 and then to discharge the suctioned air from an inside of the case 10. Of course, a structure of the fan may be employed according to a user's selection.

The main fan 61 and the sub-fans 62 enable external air to be introduced to the inside of the case 10 having a sealed structure, and simultaneously enable the air inside of the case 10 to forcibly flow and thus to cool the inside of the case 10. The air forcibly flowing in the case 10 may be discharged to the outside through the grille vent 21.

The main fan 61 may be provided between the first burner 401 and the second burner 402, and may be provided among the first burner 401, the second burner 402, and the operation panel 23. That is, the main fan 61 may be located or provided at a location formed among the operation panel 23, the first burner 401, and the second burner 402.

The air may forcibly flow toward the operation panel 23 by driving of the main fan 61, and thus may cool a PCB 231 of the operation panel 23. Through cooling of the PCB 231, the operation panel 23 and the operation part 201 of the top plate 20 may be cooled so that the user does not feel discomfort due to heat when operating the operation panel 201 of the top plate 20.

By the driving of the main fan 61, air outside of the case 10 may be introduced and forcibly flow radially to a center of the case 10. Some of the air may flow along perimeters of the first burner 401 and the second burner 402, and thus, heat from the first burner 401 and the second burner 402 does not stay at the inside of the case 10, but is discharged to the outside. Therefore, the internal space of the case 10 may be cooled by the driving of the main fan 61, and electronic components in the case 10, that is, the PCB 231 and sensors forming the operation panel 23, may also be protected.

The sub-fans 62 may serve to cool the regulator 51 and the valve assembly 70 provided at both of the first and second sides in the case 10, and may be provided at each of the first and second sides of the case 10. The sub-fans 62 may be provided inside of a space partitioned by a barrier 63. By the barrier 63, a space in which the regulator 51 and the valve assembly 70 may be disposed or provided may be partitioned from the space in which the burner 40 is provided. Therefore, by driving of the sub-fan 62, air outside of the case 10 may be introduced into the space partitioned by the barrier 63, and the regulator 51 and the valve assembly 70 may be cooled separately from the space in which the burner 40 is disposed or provided.

A fan installing portion 11 may be formed at a bottom surface of the case 10 on which the main fan 61 and the sub-fans 62 may be installed. The fan installing portion 11 may protrude in a shape corresponding to the main fan 61 and the sub-fans 62, such that the main fan 61 and the sub-fans 62 may be seated thereon. As the case 10 has a structure in which the remaining portions except for the fan installing portion 11 are sealed, the introduction of air into the case 10 may be enabled only through the fan installing portion 11. Therefore, the main fan 61 and the sub-fans 62 may have a structure which is in close contact with the case 10, and the suctioned air may be prevented from leaking through a gap between the case 10 and the main fan 61 or the sub-fans 62.

The fan installing portion 11 may be formed to protrude by a foaming when the case 10 is molded, and a grille shape may be formed at an opening of a protruding upper surface of the fan installing portion 11. Thus, a foreign substance may be prevented from being introduced while the air is suctioned.

A nozzle bracket 53 that protects the nozzle 33 and the mixing tube 34 may be further provided at the case 10. The nozzle bracket 53 may be fixed to and installed at the bottom surface of the case 10 corresponding to a location at which the nozzle 33 is installed, and also bent to cover an outside of the nozzle 33. More specifically, both of side ends of the nozzle bracket 53 may be bent in an upward direction, and form a shielding portion or shield 531, and the shield 531 may shield one side of each of the nozzle 33 and the mixing tube 34 including a space between the nozzle 33 and the mixing tube 34. Thus, the air forcibly blown by rotation of the main fan 61 may be prevented from being introduced into the space between the nozzle 33 and the mixing tube 34 and having an influence on supplying of the mixed gas.

As illustrated in the drawings, the regulator 51, which may constantly adjust a pressure of the gas supplied from an outside, and the valve assembly 70, which may selectively supply the gas supplied from the regulator 51 to the burner pot 41, may be provided inside of the case 10. A configuration of the valve assembly 70 will be described hereinafter.

The regulator 51 and the valve assembly 70 may be disposed or provided at both corners of a rear end inside of the case 10 in consideration of an arrangement and a structure of the burner assembly 30 provided inside of the case 10. The regulator 51 and the valve assembly 70 may be located on opposite sides with respect to each other, and may be connected to each other by the gas pipe 35 such that the gas is supplied thereto.

The sub-fan 62 may be provided in front of each of the regulator 51 and the valve assembly 70. The sub-fans 62, which may serve to suction the air outside of the case 10 into the case 10, then to blow the air toward the regulator 51 and the valve assembly 70, and thus, to cool the regulator 51 and the valve assembly 70, may be disposed or provided at the first and second sides of the case 10.

The barrier 63 may be provided at the first and second sides inside of the case 10. The barrier 63 may provide an installation surface for the sub-fan 62, enable the air blown by the sub-fan 62 to effectively cool the regulator 51 and the valve assembly 70, and enable the air to be discharged toward the grille vent 21. Ends of the barrier 63 may be fixed to and installed at a side surface and a rear surface of the case 10, respectively, and provide a space in which the regulator 51 or the valve assembly 70 and the sub-fan 62 may be disposed or provided. A space partitioned by the barrier 63 may be an outer area of the burner assembly 30, which may form a space in the case 10 separated from the burner assembly 30.

Therefore, the air forcibly flowing by operation of the sub-fan 62 may effectively cool the space in an area partitioned by the barrier 63. That is, the external air suctioned by the sub-fan 62 may not be mixed with the high-temperature air in the space in which the burner assembly 30 is disposed or provided, and thus, may more effectively cool the regulator 51 and the valve assembly 70.

The barrier 63 may be fixed to and installed at a lower surface of the insulator case 31, and may connect between the insulator case 31 and the case 10 to partition a space. The main fan 61, the sub-fans 62, and the barrier 63 may be provided at the lower surface of the insulator case 31.

The main fan 61 may be fixed to and installed at the lower surface of the insulator case 31 by a main fan bracket 611, and may be disposed or provided between the first burner hole 311 and the second burner hole 312. The main fan bracket 611 may enable the main fan 61 installed to be spaced apart from the insulator case 31, and may also extend to a height at which the main fan 61 is in close contact with the fan installation portion 11.

The barrier 63 may be fixed to and installed at both of first and second sides of the insulator case 31. The barrier 63 may be fixed by, for example, welding, or may be fixed to and installed at the insulator case 31 by a separate fastening member S, such as a rivet, a bolt, or a screw, for example.

The barrier 63 may generally include a fan seating portion or seat 631 that provides a surface on which the sub-fan 62 may be seated, and a partitioning portion or partition 632, which may partition the internal space of the case 10. More specifically, the fan seat 631 may be formed in an approximately triangular plate shape, and may contact the upper surface of the fan installation portion 11. An opening 631*a*, through which the air may be introduced, and a fastening hole 631*b*, to which the fastening member S may be fastened, may be formed at the fan seat 631. The fastening member S may pass through the sub-fan 62 and the coupling hole 631*b*, and be fastened thereto. Therefore, the sub-fan 62 may be fixed to the fan seat 631 by fastening the fastening member S, and the barrier 63 installed at the insulator case 31 may be assembled inside of the case 10 together with the insulator case 31. The sub-fan 62 and the fan seat 631 on which the sub-fan 62 may be seated may be installed so as to be in close contact with the protruding fan installation portion 11.

The fan seat 631 may be formed in a right-angled triangular shape, and an inclined end thereof may be connected to the partition 632, and the other end may be in close contact with a side surface of the case 10. Therefore, the barrier 63 may be maintained in a stably fixed state without vibration due to an air flow. The partition 632 may be vertically bent in an upward direction from the inclined end of the fan seat 631, and may be fixed to a lower end of the insulator case 31 to partition the internal space of the case 10.

The partition 632 may extend along the inclined end of the fan seat 631, may further extend in outward direction, and thus, may include a first partition 632*a* which partitions the case 10, and a second partition 632*b*, which may be bent from an end of the first partition 632*a* and partition the side exhaust port 315. The first partition 632*a* may partition a space between the insulator case 31 and the case 10, and guide the flow of the air blown by the sub-fan 62. The second partition 632*b* may be bent from an end of the first partition 632*a*, pass through the side exhaust port 315, and extend to be in contact with the rear end of the case 10. Accordingly, by the second partition 632*b*, the side exhaust port 315 may be divided into both of first and second sides based on the second partition 632*b*, and the cooling air flowing along the first partition 632*a* may be independently discharged through the side exhaust port 315 partitioned by the second partition 632*b*.

A bent portion 633, which may be bent in an outward may be further formed at an upper end of the first partition 632*a*. The bent portion 633 may contact the lower surface of the insulator case 31. The fastening member S, such as a screw or a bolt, for example, may be fastened to the bent portion 633 and the insulator case 31, and thus, the barrier 63 may be fixed and installed.

Figure 10:
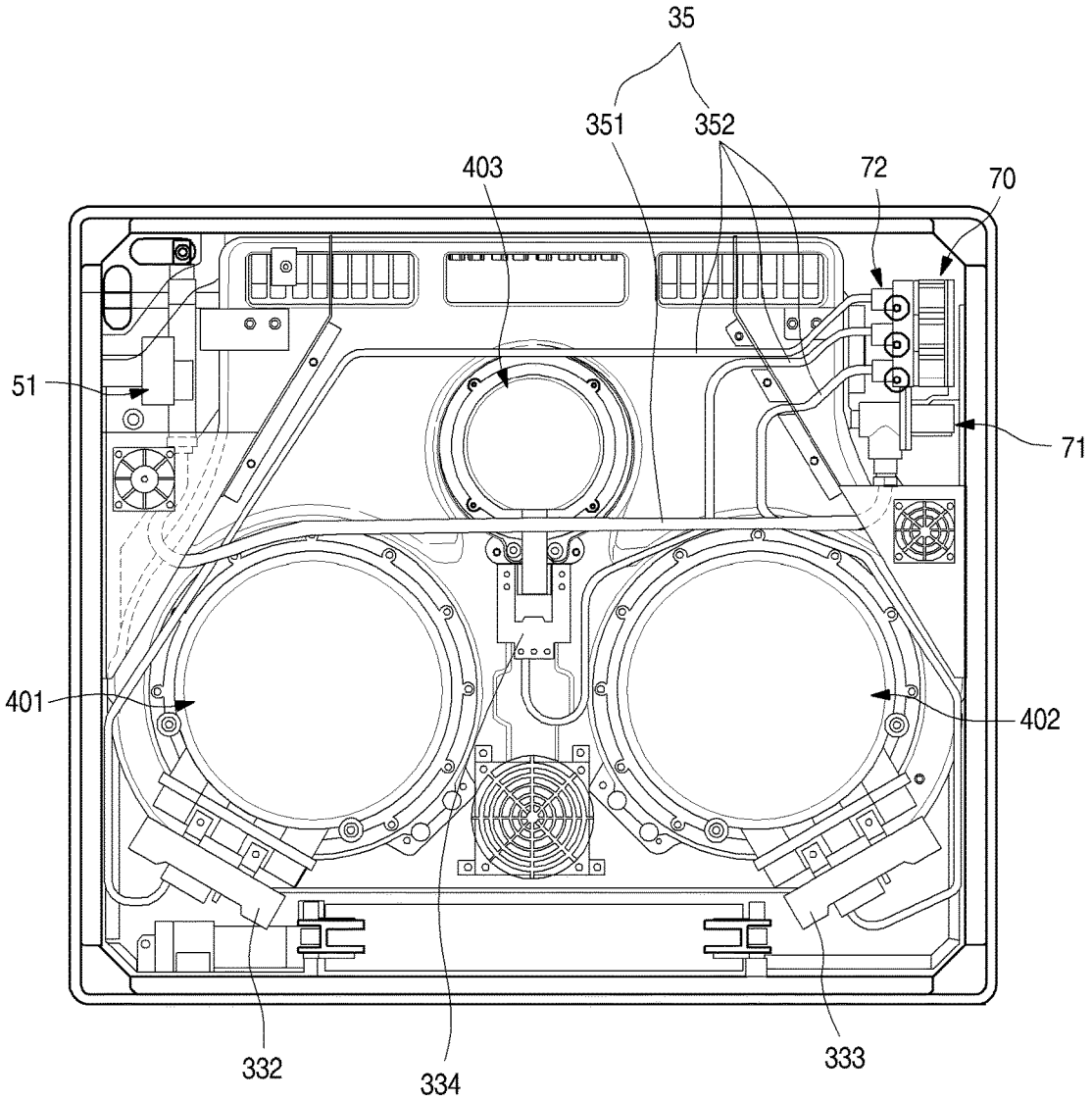
FIG. 10 is a view illustrating an arrangement of a gas pipe provided inside of the case of the gas cooker of FIG. 1.

FIG. 10 is a view illustrating an arrangement of a gas pipe provided inside of the case of the gas cooker of FIG. 1. As illustrated, the gas pipe 35 may include a main pipe 351 that connects an outlet port of the regulator 51 and the valve assembly 70, and a branched pipe 352 that connects the valve assembly 70 and the nozzle 33 of each of the plurality of burners 40.

The regulator 51 and the valve assembly 70 may be respectively disposed or provided in both first and second sides inside of the case 10, and thus, the main pipe 351 may be extended to the valve assembly 70 across the inside of the case 10. The main pipe 351 may be connected to a main valve 71 of the valve assembly 70 and may supply the fuel gas. The branched pipe 352 may be connected to the nozzles 33 from a plurality of sub-valves 72 of the valve assembly 70.

The plurality of nozzles 33 may be located at positions corresponding the first burner 401, the second burner 402, and the third burner 403, respectively. A first nozzle 332 and a second nozzle 333 that supply the fuel gas to the first burner 401 and the second burner 402 may be, respectively, positioned at a front portion of the case 10. This is because the valve assembly 70 may be located at a rear side of the case 10, and thus, configured to provide a sufficient space at the front portion inside of the case 10.

More specifically, the first nozzle 332 and the second nozzle 333 may be disposed or provided in a space between the first burner 401, the second burner 402, and an edge of the front portion of the case 10, and thus, utilization of a space of the case 10 may be improved. A third nozzle 334 that supplies the fuel gas to the third burner 403 may be located or provided in a space between the first burner 401 and the second burner 402, and use a space formed by the arrangement of the plurality of burners 40.

The valve assembly 70 may be fixed to and installed at one side wall surface of both first and second sides of the case 10. The main valve 71 and the plurality of sub-valves 72 may be configured as a single assembly form.

Hereinafter, the valve assembly 70 will be described with reference to the drawings.

Figure 11:
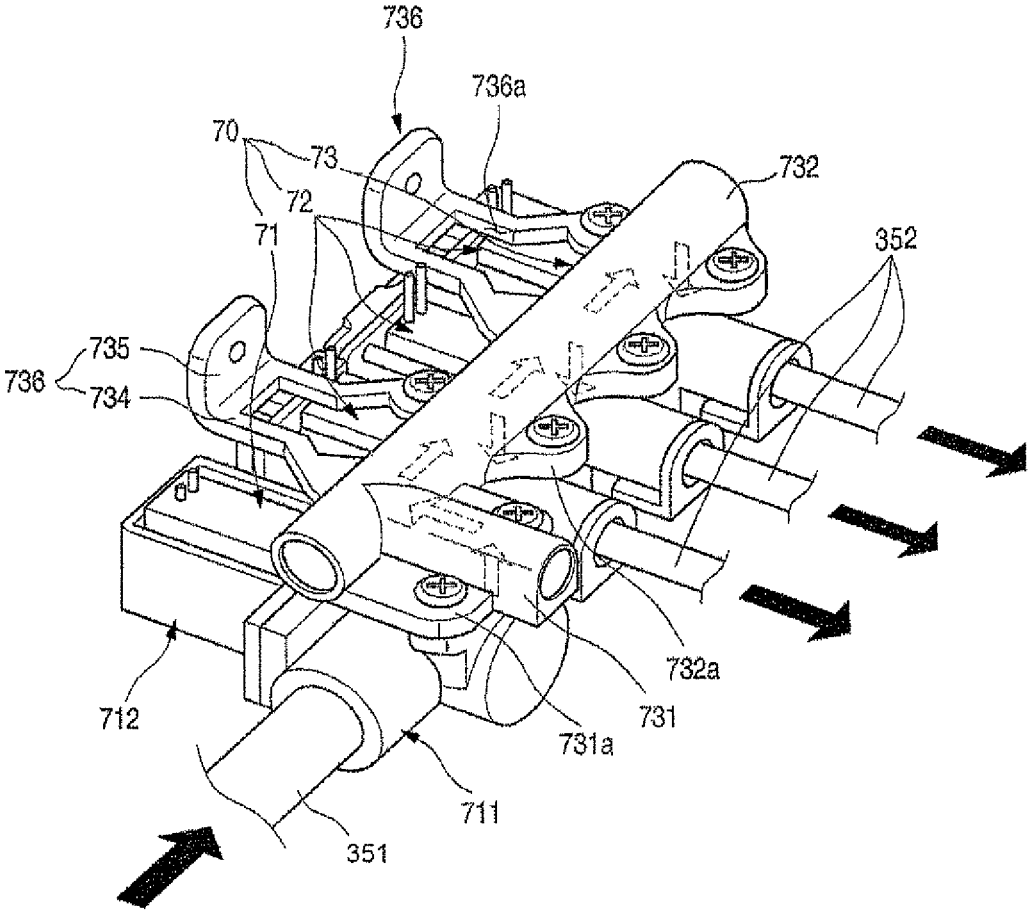
FIG. 11 is a perspective view showing a valve assembly from an upper side according to an embodiment.
Figure 12:
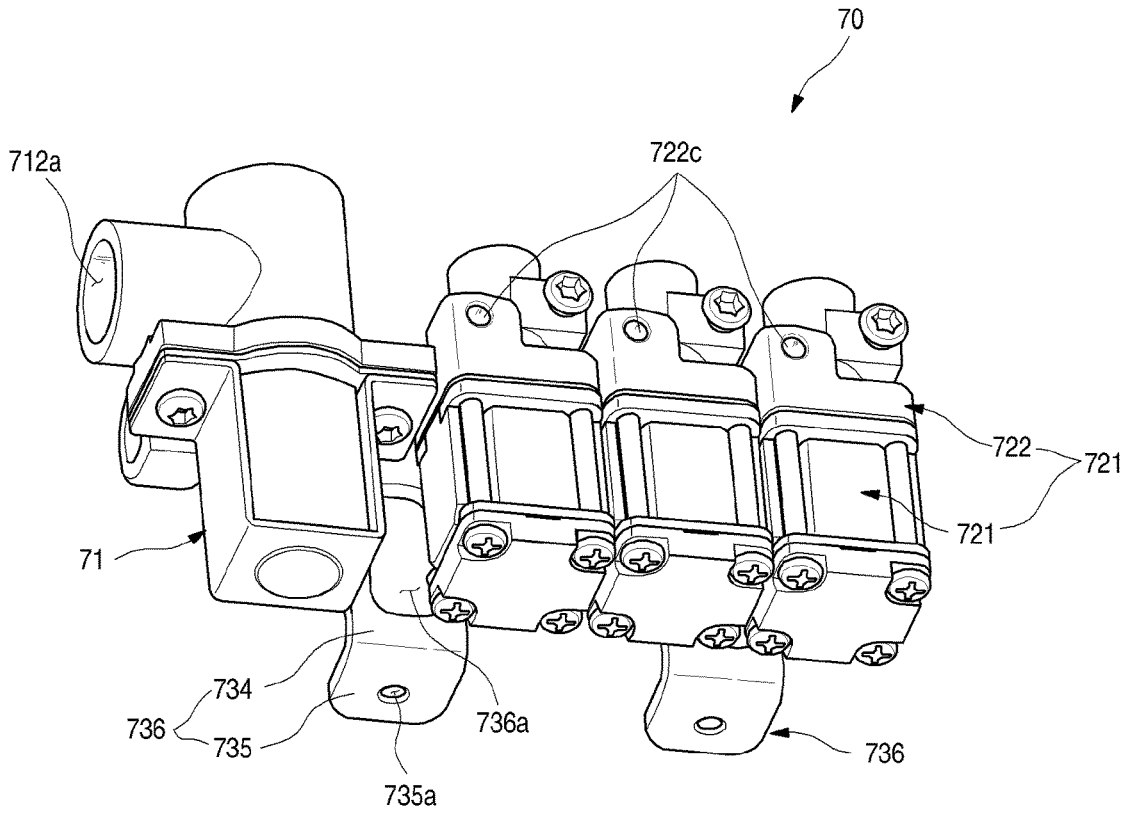
FIG. 12 is a perspective view showing the valve assembly of FIG. 11 from a lower side.
Figure 13:
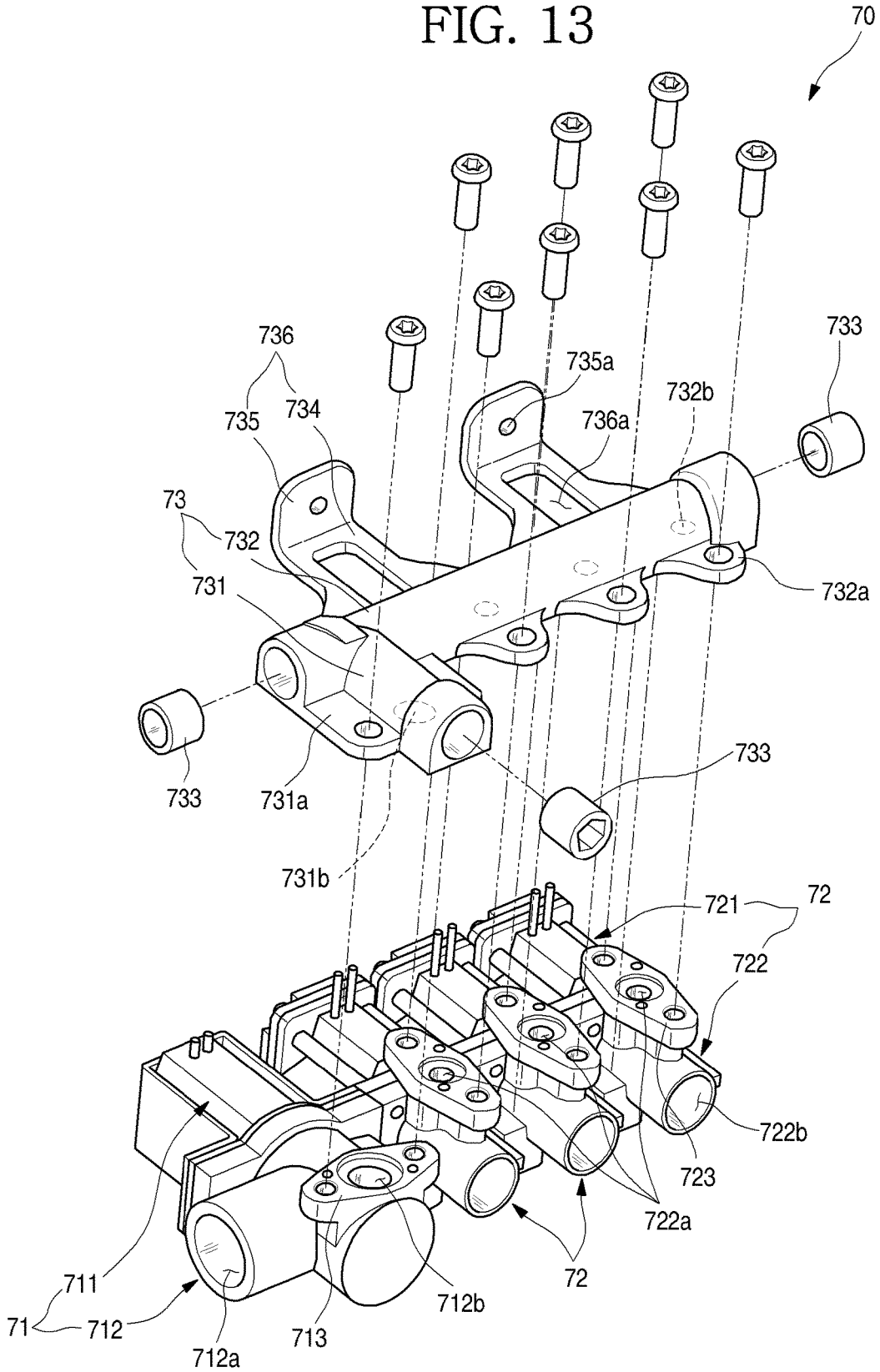
FIG. 13 is an exploded perspective view of the valve assembly of FIG. 11.
Figure 14:
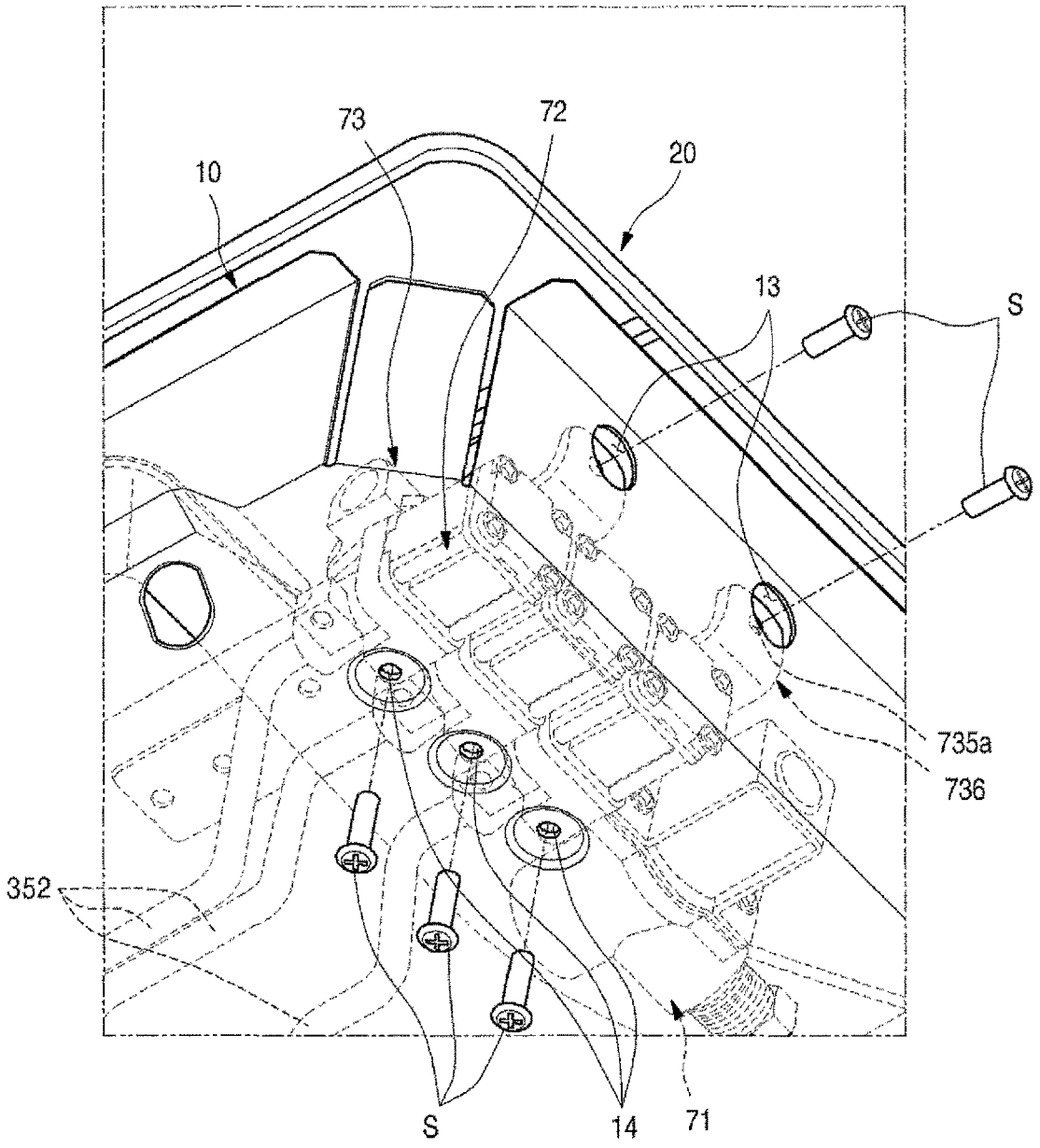
FIG. 14 is a partially perspective view illustrating a mounting state of the valve assembly of FIG. 11.

FIG. 11 is a perspective view showing a valve assembly according to an embodiment from an upper side. FIG. 12 is a perspective view showing the valve assembly of FIG. 11 from a lower side. FIG. 13 is an exploded perspective view of the valve assembly of FIG. 11. FIG. 14 is a partially perspective view illustrating a mounting state of the valve assembly of FIG. 11.

As illustrated in the drawing, the valve assembly 70 may include the main valve 71 and the sub-valve 72, and a manifold 73 that connects the main valve 71 and the sub-valve 72. The main valve 71 and the sub-valve 72 may each be an electric control valve, for example, a solenoid valve.

The main valve 71 may be connected to an end of the main pipe 351 connected to the regulator 51, and may be configured to determine a supply of the fuel gas to the sub-valve 72. That is, the supply of the fuel gas to the sub-valve 72 may be prevented while the main valve 71 is closed.

The sub-valve 72 may be connected to the main valve 71 by the manifold 73, formed as many as a number corresponding to a number of the plurality of burners 40, and configured to independently supply the fuel gas to the corresponding burner 40, more specifically, the nozzle 33. The sub-valve 72 is opened and closed by an operation signal of the operation panel 23. Therefore, the amount of fuel gas supplied to the burner 40 may be controlled by operation of the operation panel 23 by the user, and heating power of the burner 40 may be controlled.

As the main valve 71 communicates with the plurality of sub-valves 72, a capacity and size of the main valve 71 may be formed larger than a capacity and size of the sub-valves 72. The plurality of sub-valves 72 may be consecutively disposed or provided at a side of the main valve 71. The main valve 71 and the plurality of sub-valves 72 may be connected in parallel with each other by the manifold 73, configured in a single assembly form, and may be fixed to and installed at or in the case 10.

The main valve 71 may be configured to include a coil portion 711, in which a coil to form a magnetic field and a valve body moved forward and backward by the magnetic field are housed, and a body portion or body 712 which may be coupled to the coil portion 711 and in which an internal flow path may be opened and closed by the valve body.

An inlet port 712*a* and an outlet port 712*b* may be respectively formed in the body 712, and the body 712 may be fixed and coupled to the manifold 73. For this, a body coupling portion 713 may be further formed or provided in the body 712, and the body coupling portion 713 may be coupled to a main coupling portion 731*a* of the manifold 73 so that the main valve 71 may be fixed to and installed at the manifold 73.

The inlet port 712*a* of the main valve 71 may be open at a side portion of the body 712 and configured to facilitate connection with the main pipe 351, and the outlet port 712*b* of the body portion 712 may communicate with a main hole 731*b*, which is an inlet port of the manifold 73 when the manifold 73 is coupled.

The sub-valves 72 may also include a coil portion 721 and a body 722, and only a size may be different from a size of the main valve 71. A body coupling portion 723 may be formed at the body 722 and coupled with a sub-coupling portion 732*a* of the manifold 73, and the sub-valve 72 may be fixed to and installed at the manifold 73, one or more fastening hole 722*c* may be formed on a bottom surface of the body 722, and configured such that a fastening member S that penetrates a bottom hole 14 formed on the bottom surface of the case 10 may be fastened, and thus, the valve assembly 70 may be fixed.

An inlet port 722*a* of the sub-valve 72 may be open to an upper portion of the body portion 722, and may communicate with a sub-hole 732*b*, which is an outlet port of the manifold 73 when the manifold 73 is coupled. An outlet port 722*b* of the sub-valve 72 may be open in a forward direction, that is, in an extending direction of the sub-valve 72. The outlet port 712*b* of the main valve 71 and the inlet port 722*a* of the sub-valve 72 may be located at a position deviated from a same extension line.

The body coupling portions 713 and 723 of the main valve 71 and the sub-valves 72 may be respectively formed in a direction crossing each other for assembly performance and space utilization of the main valve 71 and the sub-valves 72. The body coupling portion 713 of the main valve 71 may extend and be formed in a direction intersecting an extending direction of the main valve 71, and the body coupling portion 723 of the sub-valves 72 may extend and be formed in a same direction with the extending direction of the sub-valve 72. Both of the main valve 71 and the sub-valves 72 may be independent and separated from each other, and having a structure coupled with the manifold 73.

The manifold 73 may have a tubular shape and a structure that communicates with the outlet port 712*b* of the main valve 71 and the inlet port 722*a* of the sub-valve 72. Therefore, the fuel gas passing through the main valve 71 may be guided toward an inner side of the sub-valve 72 via the manifold 73.

The manifold 73 may be configured to include a sub-connecting portion or connector 732 extended along an arrangement direction of the sub-valve 72, and a main connecting portion or connector 731 extended vertically from the sub-connector 732 and communicating with the main valve 71. The main hole 731 b may be open to a bottom surface of the main connector 731, and the sub-hole 732*b* may be formed along a longitudinal direction of the sub-connector 732. Therefore, the main hole 731*b* and the sub-hole 732*b* may also not be located on a same extension line.

That is, while the size of the main valve 71 is larger, by aligning an end of the main valve 71 so as to be positioned on the same extension line with an end of the sub-valve 72, interference with an inner side surface of the case 10 when the valve assembly 70 is mounted in the inside the case 10 may be avoided.

An end cap 733 may be provided on an open end of the manifold 73, in other words, both ends of the sub-connector 732 and one end of the main connector 731. That is, the open end, which may be formed when the manifold 73 is molded, may be shielded by the end cap 733.

A valve installation portion 736 may be formed on the manifold 73. One pair of valve installation portions 736 may extend and be formed at one side of the manifold 73, and be configured to be coupled and fixed to an inner side wall surface of the case 10. The valve installation portion 736 may include an extending portion 734 that extends from one side of the manifold 73 to an aligned end of the main valve 71 and the sub-valve 72, and a bent portion 735 bent from an end of the extending portion 734 and in close contact with the side surface of the case 10. A fastening hole 735*a*, in which a fastening member S penetrating a side hole 13 formed in the case 10 may be fastened, may be formed in the bent portion 735.

An extending length of the valve installation portion 736 may be formed longer than lengths of the main valve 71 and the sub-valve 72 so that rear ends of the main valve 71 and the sub-valve 72 do not interfere with the case 10. An opening 736*a* may be formed on the extending portion 734 of the valve installation portion 736, and thus, fluidity of the air may be further improved.

Therefore, as shown in FIG. 14, the valve assembly 70 may be respectively fixed by the fastening member S penetrating the bottom surface of the case 10 and the fastening member S penetrating the side surface of the case 10, and the valve assembly 70 may be maintained in a stable installed state. A plurality of valves may be provided in a single assembly, and thus, the valve assembly 70 may be entirely fixed by engagement of the fastening member S.

Hereinafter, an operation of the gas cooker having the configuration discussed according to an embodiment will be described.

The user operates the operation part 201 exposed at the top plate 20 to use the gas cooker 1. An input of an operation signal through the operation panel 23 is possible through operation of the operation part 201.

The main valve 71 may be opened by the operation signal of the operation panel 23, and as shown in FIG. 11, a fuel gas of a uniform pressure passing through the regulator 51 may pass through the main valve 71 via the main pipe 351 by opening of the main valve 71.

The fuel gas passing through the main valve 71 may move to the sub-connector 732 through the main connector 731 of the manifold 73. The sub-valve 72 may also be opened by the operation signal of the operation panel 23, and the fuel gas of the main connector 731 of the manifold 73 may pass through the opened sub-valve 72 by the opening of the given sub-valve 72 and supplied toward the corresponding nozzle 33 along the branched pipe 352. Gas may be injected into the mixing tube 34 side in the nozzle 33.

The plurality of nozzles 33 may supply gas to each of the extension tubes 341, and the gas may be injected toward an inlet port side of the spaced extension tube 341, and thus, a surrounding air may be mixed and introduced into the inside of the burner pot 41 and ignited by the spark plug 32. The mixed gas supplied into the accommodating portion 411 may be evenly supplied to the entire red-hot plate 42, combusted by the ignition of the spark plug 32, and a flame may be uniformly formed on the red-hot plate 42.

Figure 15:
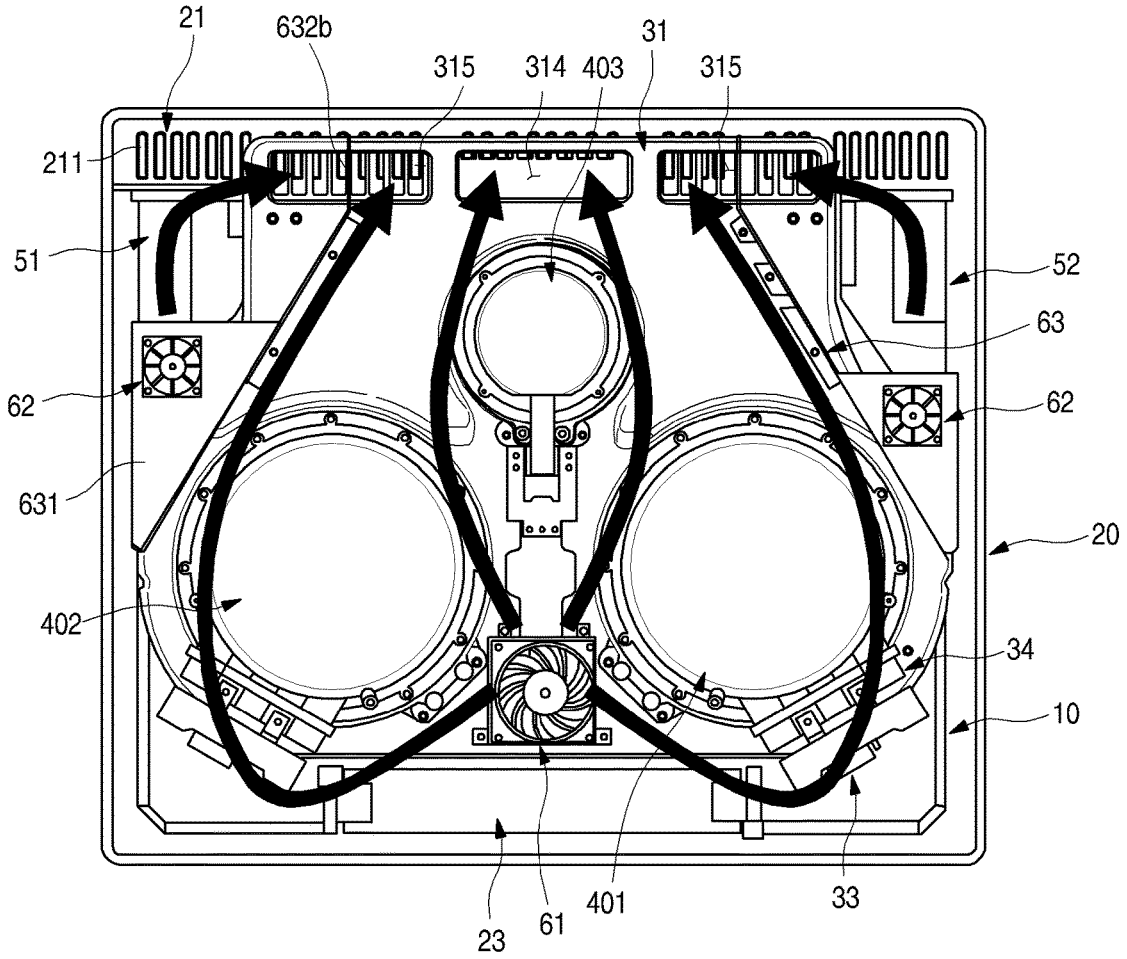
FIG. 15 is a view illustrating a flow state of internal air of the gas cooker of FIG. 1.

FIG. 15 is a view illustrating a flow state of internal air of the gas cooker of FIG. 1. As illustrated in the drawing, the main fan 61 and the sub-fans 62 may be driven along with ignition of the plurality of burners 40. By the driving the main fan 61, the air in the case 10 may be suctioned toward the main fan 61. The suctioned air may be discharged radially centering on the main fan 61.

Some of the air blown through the main fan 61 may flow toward the PCB 231 of the operation panel 23, and thus, the PCB 231 may be continuously cooled so as to be operated normally. A portion of the air blown through the main fan 61 may pass between the first burner 401 and the second burner 402, and then may be discharged to the central exhaust port 314 along an outer side surface of the third burner 403. The remaining portion of the air blown by the main fan 61 may flow along a space among the first burner 401, the second burner 402, and the side surface of the case 10, flow along the barrier 63 which partitions the internal space of the case 10, and then may be discharged to one side of the side exhaust port 315.

As described above, by rotation of the main fan 61, the air in the case 10 continuously cools the operation panel 23 and the front half portion of the top plate 20, and the air close to the first burner 401, the second burner 402, and the third burner 403 may be discharged, and thus, an internal temperature of the case 10 may be prevented from being increased to a preset or predetermined temperature or more.

By the flow of the cooling air discharged through the central exhaust port 314 and the side exhaust ports 315, the burned gas generated upon combustion in the first burner 401, the second burner 402, and the third burner 403 may be mixed with the cooling air by a pressure difference, and may be discharged together. At this point, the high-temperature burned gas may be mixed with the cooling air discharged from the inside of the case 10, and is in a low-temperature state, and then may be discharged to the outside through the vent holes 211 of the grille vent 21. When the sub-fan 62 is driven, the air outside the case 10 may be introduced into the case 10, and thus, may independently cool the internal space formed at each of both sides of the case 10 partitioned by the barrier 63.

A gas cooker 1 according to another embodiment may include the same top plate 20 and case 10 as those in the previous embodiment, and an internal structure of the case 10 may also be the same. However, the gas cooker 1 according to this embodiment may be formed to be seated on an outer case which forms an exterior while the top plate 20 and the case 10 are assembled. Of course, if necessary, instead of the configuration of the case 10, the top plate 20 may be directly installed at or on the outer case, and all of the elements including the burner assembly 30 which are disposed or provided in the case 10 may be installed inside of the outer case.

With a gas cooker and valve assembly for a gas cooker according to embodiments disclosed herein, at least the following advantages may be expected.

First, in a structure in which a main valve connected to a regulator is connected to a sub-valve respectively connected to a plurality of burners, a fuel gas supply to the sub-valve may be determined by the opening and closing of the main valve. Therefore, in a case in which a problem of the fuel gas supply occurs or even an error occurs in the sub-valve, the fuel gas supply by the main valve may be blocked, and thus, stability may be improved.

Second, as the main valve and the sub-valve may be in a compact configuration by being configured in an assembly form by a manifold, a space inside of the case may be less occupied. Thus, there is an advantage that space efficiency of the case may be improved.

Third, a nozzle may be disposed or provided in a space at a front portion of the case by disposing or providing a valve unit or assembly in a compact configuration at a rear of the case. Thus, there is an advantage that flowability of an overall fluid, such as fuel gas and combustion gas, may be improved.

Fourth, a plurality of valves may be formed in a single assembly form, and mounting of the valve assembly may be possible by a simple procedure through which the valve assembly may penetrate the case and a fastening member may be fastened to the manifold and a housing of each of the valves. Thus, improvement of assembly workability and productivity may be expected.

In particular, due to a structure of the manifold through which ends of the main valve and the sub-valve having different sizes may be aligned on a same line, the valve assembly may be disposed or provided to be in close contact with a side surface of the case, and may be easily assembled and disassembled by using the fastening member at an outer side of the case, and thus, an effect that significantly improves productivity and serviceability may be expected.

Embodiments disclosed herein are directed to providing a gas cooker which enables an electric valve that controls heating power of a plurality of burners to be configured in a single assembly and mounted inside of a case, and thus, has an entirely compact configuration, and may improve assembly workability and productivity at the same time, and a valve assembly for the gas cooker. Embodiments disclosed herein are also directed to providing a gas cooker which may improve stability, assembly, and productivity by configuring a main valve that supplies fuel gas to a plurality of sub-valves that controls heating power of each of the burners in a single module, and a valve assembly for the gas cooker.

Embodiments disclosed herein provide a gas cooker that may include a case; a top plate that shields an upper surface of the case and on which food or other items may be seated; a plurality of burners provided inside of the case; an electric valve unit or assembly that controls a supply of gas to the plurality of burners; a main pipe connected to the electric valve unit and supplying gas; and a plurality of branched pipes respectively connected to the electric valve unit and the burners. The electric valve unit may include a main valve connected to the main pipe, and a plurality of sub-valves configured integrally with the main valve and respectively connected to the plurality of branched pipes.

The electric valve unit may further include a manifold that enables the main valve and the sub-valves to be consecutively arranged in parallel and form a gas flow passage of the main valve and the sub-valves. Ends of the main valve and the sub-valve may be aligned on a same extension line.

The manifold may include a sub-connecting portion or sub-connector in which outlet ports connected to the sub-valves along a longitudinal direction may be consecutively formed, and a main connecting portion or connector that extends in a direction crossed at the sub-connecting portion, and in which an inlet port connected to the main valve may be formed. The manifold may be formed in a tubular shape, and have an end cap that shields both ends of the sub-connecting portion and an opened end of the main connecting portion.

A valve installing portion further extending than the ends of the main valve and the sub-valve, and fixed to and installed at a side wall of the case may be formed in the manifold. A plurality of body coupling portions respectively coupled to the main valve and the sub-valves may be formed in the manifold.

The body coupling portion may be formed on the valve installing portion. The valve installing portion and the body coupling portion may be molded together when the manifold is injection-molded.

The main valve and the sub-valve may include a coil portion in which a coil that forms a magnetic field and a road or path moved forward and backward by the magnetic field may be built-in, and a body portion or body coupled with the valve installing portion, communicated with the manifold, and forming a flow passage opened and closed by the road. A fastening hole fastened to a fastening member that penetrates a bottom of the case may be formed in the electric valve unit.

A regulator that maintains a supplied gas pressure may be connected to the main pipe.

A cooling fan that sucks a cooling air outside of the case and an exhaust port that exhausts the cooling air may be provided in the case. The electric valve unit may be disposed or provided between the cooling fan and the exhaust port.

A barrier that partitions the inside of the case so as to accommodate the cooling fan, the exhaust port, and the electric valve unit in a same space may be provided inside of the case.

An operation unit or panel that detects a user's touch operation of the top plate and transmits an operation signal to the valve unit may be provided on a lower surface of the top plate.

Embodiments disclosed herein further provide a valve unit or assembly for a gas cooker, which is a valve unit that supplies gas to a plurality of burners in which a red-hot plate heated by combustion of a mixed gas may be provided, including a main valve connected to a main pipe in which gas may be supplied; a plurality of sub-valves respectively connected to a branched pipe individually connected to the plurality of burners; and a manifold that connects the main valve and the sub-valves in parallel, but enabling the main valve and the sub-valves to be consecutively disposed or provided. All of the main valve and the sub-valves may be an electric valve and coupled to the manifold and configured in a single assembly form. Ends of the main valve and the sub-valve may be aligned on a same extension line.

The manifold may include a sub-connecting portion or sub-connector, in which outlet ports connected to the sub-valves along a longitudinal direction may be consecutively formed, and a main connecting portion or connector extended in a direction crossed at the sub-connecting portion, and in which an inlet port connected to the main valve may be formed. The manifold may be formed in a tubular shape, and have an end cap that shields both ends of the sub-connecting portion and an open end of the main connecting portion.

A valve installing portion further extending than the ends of the main valve and the sub-valve, and fixed to and installed at a side wall of the case forming an outer shape of the gas cooker may be formed in the manifold.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas cooker, comprising:

a case;

a top plate that shields an upper surface of the case, and on which items to be cooked are seated;

a plurality of burners provided inside of the case;

an electric valve assembly that controls a gas supply to the plurality of burners;

a main pipe connected to the electric valve assembly and that supplies gas; and a plurality of branched pipes, respectively, connected to the electric valve assembly and the plurality of burners, wherein the electric valve assembly includes:

a main valve connected to the main pipe; and a plurality of sub-valves configured integral with the main valve and respectively connected to the plurality of branched pipes, wherein the electric valve assembly further includes a manifold that enables the main valve and the plurality of sub-valves to be mounted consecutively and connected in parallel, and forms a gas flow passage of the main valve and the plurality of sub-valves, and wherein ends of the main valve and the plurality of sub-valves are aligned on a same straight line, and by aligning the end of the main valve so as to be positioned on the same straight line with the ends of the plurality of sub-valves, interference with an inner side surface of the case when the electric valve assembly is mounted in the inside of the case is avoided.

2. The gas cooker according to claim 1, wherein the manifold includes:

a sub-connector in which outlet ports connected to the plurality of sub-valves are consecutively formed along a longitudinal direction; and a main connector that extends in a direction perpendicular to the sub-connector and having an inlet port connected to the main valve.

3. The gas cooker according to claim 2, wherein the manifold is formed in a tubular shape, and end caps that shield both ends of the sub-connector and an open end of the main connector are provided.

4. The gas cooker according to claim 1, wherein the manifold includes one or more valve installation portion that extends further than the ends of the main valve and the plurality of sub-valves and is configured to be fixed to and installed at a side wall of the case.

5. The gas cooker according to claim 4, wherein the manifold includes a plurality of body coupling portions respectively coupled to the main valve and the plurality of sub-valves.

6. The gas cooker according to claim 5, wherein the plurality of body coupling portions is formed on the one or more valve installation portion.

7. The gas cooker according to claim 6, wherein the main valve and the plurality of sub-valves each includes:

a coil portion in which a coil that forms a magnetic field and a valve body that moves forward and backward by the magnetic field are housed; and a body coupled with the one or more valve installation portion, that communicates with the manifold, and forming a flow passage opened and closed by the valve body.

8. The gas cooker according to claim 7, wherein the body of the main valve includes:

an inlet port configured to be connected with the main pipe and provided at a side portion of the body;

an outlet port opening in an upper portion of the body and communicating with an inlet port of the manifold when the manifold is coupled to the main valve; and a body coupling portion provided in the upper portion of the body and coupled to the respective plurality of body coupling portions of the manifold.

9. The gas cooker according to claim 7, wherein the body of the plurality of sub-valves each includes:

an inlet port opening in an upper portion of the body and communicating with a respective plurality of outlets of the manifold when the manifold is coupled with the plurality of sub-valves;

an outlet port opening in an extending direction of the plurality of sub-valves and configured to be connected with respective plurality of branch pipe; and a body coupling portion provided in the upper portion of the body and coupled to the respective plurality of body coupling portions of the manifold.

10. The gas cooker according to claim 5, wherein the one or more valve installation portion and the plurality of body coupling portions are molded together when the manifold is injection-molded.

11. The gas cooker according to claim 4, wherein the electric valve assembly includes at least one fastening hole fastened with a fastening member that penetrates a bottom of the case.

12. The gas cooker according to claim 1, wherein a regulator that maintains a supplied gas pressure is connected to the main pipe.

13. The gas cooker according to claim 1, wherein at least one cooling fan that suctions a cooling air from outside of the case, and at least one exhaust port that exhausts the cooling air are provided in the case, and wherein the electric valve assembly is provided between the at least one cooling fan and the at least one exhaust port.

14. The gas cooker according to claim 13, wherein at least one barrier that partitions the inside of the case so as to accommodate the at least one cooling fan, the at least one exhaust port, and the electric valve assembly in a same space is provided inside of the case.

15. The gas cooker according to claim 1, wherein an operation panel that detects a user's touch operation on the top plate and transmits an operation signal to the electric valve assembly is provided on a lower surface of the top plate.

16. The gas cooker according to claim 1, wherein a size of the main valve is larger than a size of the plurality of sub-valves.

17. A valve assembly for supplying gas to a plurality of burners of a cooker in which a red-hot plate heated by combustion of a mixed gas is provided, the valve assembly comprising:

a main valve connected to a main pipe through which gas is supplied;

a plurality of sub-valves respectively connected to a branched pipe which is individually connected to each of the plurality of burners; and a manifold that connects the main valve and the plurality of sub-valves in parallel and enables the main valve and the plurality of sub-valves to be consecutively provided, wherein all of the main valve and the plurality of sub-valves are electric valves and are coupled with the manifold and configured in a single assembly form, and wherein ends of the main valve and the plurality of sub-valves are aligned on a same straight line, and by aligning the end of the main valve so as to be positioned on the same straight line with the ends of the plurality of sub-valves, interference with an inner side surface of the case when the electric valve assembly is mounted in an inside of the case is avoided.

18. The valve assembly according to claim 17, wherein the manifold includes:

a sub-connector in which outlet ports connected to the plurality of sub-valves are consecutively formed along a longitudinal direction; and a main connector that extends in a direction perpendicular to the sub-connector and having an inlet port connected to the main valve.

19. The valve assembly according to claim 18, wherein the manifold is formed in a tubular shape, and end caps that shield both ends of the sub-connector and an open end of the main connector are provided.

20. The valve assembly according to claim 17, wherein the manifold includes one or more valve installation portion that extends further than the ends of the main valve and the plurality of sub-valves and is configured to be fixed to and installed at a side wall of the case forming an outer shape of the gas cooker.

* * * * *